US005738453A

United States Patent [19]

Tsuburaya et al.

[11] Patent Number: 5,738,453

[45] Date of Patent: Apr. 14, 1998

[54] SHEET SUPPLYING APPARATUS

[75] Inventors: Kenichi Tsuburaya, Ibaraki-ken; Shoichi Kan; Nozomu Nishiberi, both of Yokohama; Hiroshi Suzuki, Ibaraki-ken, all of Japan

[73] Assignee: Canon Kabushiki Kaisha, Tokyo, Japan

[21] Appl. No.: 365,675

[22] Filed: Dec. 29, 1994

[30] Foreign Application Priority Data

Dec. 30, 1993 [JP] Japan ..... 5-354507

[51] Int. Cl.[6] ..... B41J 13/036

[52] U.S. Cl. ..... 400/624; 400/629; 400/605; 271/9.13

[58] Field of Search ..... 400/624, 625, 400/629, 605; 271/9.01, 9.13, 9.08

[56] References Cited

U.S. PATENT DOCUMENTS

| | | | |
|---|---|---|---|
| 4,248,415 | 2/1981 | Steinhilber | 400/624 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,475,731 | 10/1984 | Wood . | |
| 4,558,333 | 12/1985 | Sugitani et al. . | |
| 4,608,577 | 8/1986 | Hori . | |
| 4,620,809 | 11/1986 | Runzi | 400/624 |
| 4,723,129 | 2/1988 | Endo et al. . | |
| 4,740,796 | 4/1988 | Endo et al. . | |
| 4,865,305 | 9/1989 | Momiyna et al. | 400/624 |
| 4,879,578 | 11/1989 | Hisajima et al. | 271/9.13 |
| 5,145,164 | 9/1992 | Kan . | |

FOREIGN PATENT DOCUMENTS

| | | |
|---|---|---|
| 59-123670 | 7/1974 | Japan . |
| 54-56847 | 5/1979 | Japan . |
| 59-138461 | 8/1984 | Japan . |
| 60-71260 | 4/1985 | Japan . |

*Primary Examiner*—David A. Wiecking
*Attorney, Agent, or Firm*—Fitzpatrick, Cella, Harper & Scinto

[57] ABSTRACT

The present invention relates to a sheet supplying apparatus for selecting and supplying a sheet from a plurality of sheet supply portions. Each of the sheet supply portion comprises a sheet supporting means for supporting the sheets, a rotatable sheet supply means for feeding out the sheet supported by the sheet supporting means, a drive source for driving the rotatable sheet supply means, a drive transmitting means for transmitting or not transmitting a driving force of the drive source to the rotatable sheet supply means, and a control means for controlling the transmission and non-transmission of the drive transmitting means.

17 Claims, 20 Drawing Sheets

UPON SELECTION OF 1ST ASF

UPON SELECTION OF 2ND ASF

SHEET SUPPLYING APPARATUS

BACKGROUND OF THE INVENTION

1. Field of the Invention

The present invention relates to an automatic sheet supplying apparatus wherein a recording material can be picked up from any tray among a plurality of trays each containing a plurality of recording materials, and a recording apparatus to which such an automatic sheet supplying apparatus can be mounted. Incidentally, in this specification and claims, the term "recording" or "record" includes application of ink (print) to all of materials to which ink can be applied, such as a cloth web, a thread, a paper sheet, a sheet material and the like, and the recording apparatus includes a printer as an output device for all of information processing systems. Thus, the present invention can be applied to all of such systems.

2. Related Background Art

In recording apparatuses having printer function, copying function or facsimile function, or in recording apparatuses used as an output device for a composite system or a work station including a computer or a word processor, an image is formed on a recording material such as a paper sheet, a thin plastic film (OHP sheet) or the like on the basis of image information. Such recording apparatuses can be grouped into ink jet recording type, wire dot recording type, heat-sensitive recording type, heat-transfer recording type, laser beam recording type and the like in accordance with the kinds of recording means to be used. Among the above-mentioned recording apparatuses, a recording apparatus of ink jet type is designed so as to record an image by discharging ink from a recording head toward a recording material and has advantages that the recording means can easily be made compact, that highly accurate fine image can be recorded at a high speed, that the image can be recorded on a plain paper sheet without any special treatment, that the running cost is cheap, that noise can be reduced because of non-impact recording and that a color image can easily be recorded by utilizing a plurality of different color inks.

Not only in the ink jet recording apparatuses but also in the recording apparatuses of other type such as wire dot recording type, laser beam recording type, an automatic sheet feeder (referred to as "ASF" hereinafter) including a plurality of cassettes or trays is used to supply sheets (recording materials) to a recording head continuously and quickly. In a conventional ASF, there is provided a switching mechanism for changing one cassette or tray to another cassette or tray, which mechanism has electrical connection to control ON/OFF of a clutch by using a solenoid or does not have such electrical connection but selects a desired cassette or tray by using normal and reverse rotations of a drive source.

However, when the solenoid and the like is used, since an electric circuit is required, thus increasing the cost, and since the electrical connection is required, the mounting/dismounting is made difficult and the poor electrical connection is caused when the mounting and dismounting are frequently repeated, thereby worsening the reliability. On the other hand, when the normal and reverse rotations of the drive source is used to select the cassette or tray in the ASF, only two cassettes can be used at the most, thereby decreasing the degree of freedom. Further, a new exclusive drive source for the ASF must be added or the existing drive source must be used as an exclusive drive source by switching or changing gears, thereby making the apparatus complex and expensive.

An example of a conventional ASF is disclosed in U.S. Pat. No. 4,475,731. Such an ASF comprises mechanical selecters each provided for plural cassettes and connected to drive means for driving sheet supply rollers associated with the cassettes, a set of combination means each associated with the corresponding mechanical selecter and positioned at a predetermined angular position by combination of normal and reverse rotations of the drive means, and connection means for connecting the combination means and each sequence of the drive means. With this arrangement, the selecter is operated in response to pre-selected series of normal and reverse rotations of the combination means to transmit a driving force of the drive means to the sheet supply roller connected to the drive means and to select a desired cassette.

However, in the conventional ASF, when the combination means has a plurality (n−1) of combination disks, n (in number) reverse rotations are required for initializing the combination means prior to selection of cassette. Thus, for example, when it is desired to suddenly change one cassette to another cassette because of emptiness of the sheet, the recording operation of the recording apparatus must be temporarily stopped or delayed, thereby interfering with the high speed recording which has recently been requested. Further, since a group of selectable cassettes are removably contained within a large frame and the frame is non-detachably secured to the recording apparatus, the entire apparatus inevitably becomes bulky.

SUMMARY OF THE INVENTION

An object of the present invention is to provide an ASF which can cope with the high speed recording, and a recording apparatus having such an ASF.

Another object of the present invention is to provide an ASF which can easily be mounted to and dismounted from a recording apparatus and which is very reliable and cheap, and a recording apparatus having such an ASF.

To achieve the above objects, according to the present invention, there is provided a sheet supplying apparatus for selecting a sheet from a plurality of sheet supply portions and for supplying a selected sheet, wherein each sheet supply portion comprises a sheet supporting means for supporting the sheets, a rotatable sheet supply means for feeding out the sheet supported by the sheet supporting means, a drive source for driving the rotatable sheet supply means, a drive transmitting means for transmitting or not transmitting a driving force of the drive source to the rotatable sheet supply means, and a control means for controlling the transmission and non-transmission of the drive transmitting means, and further wherein the control means provided in association with one of the sheet supply portions causes the drive transmitting means to transmit the driving force to the rotatable sheet supply means in accordance with different rotational amount of the drive source.

BRIEF DESCRIPTION OF THE DRAWINGS

FIG. 8A is a view showing a trace of a pawl portion of the control pawl slidingly driven on the cam portion when the first tray is selected, FIG. 8B is a view similar to FIG. 8A, showing the trace of the pawl portion of the control pawl slidingly driven on the cam portion when the first tray is selected, FIG. 8C is a view showing a trace of the pawl portion of the control pawl slidingly driven on the cam portion when a second tray is selected, and FIG. 8D is a view similar to FIG. 8C, showing the trace of the pawl portion of the control pawl slidingly driven on the cam portion when the second tray is selected;

DETAILED DESCRIPTION OF THE PREFERRED EMBODIMENTS

The present invention will now be explained in connection with embodiments thereof with reference to the accompanying drawings.

[First Embodiment]

Figure 1:
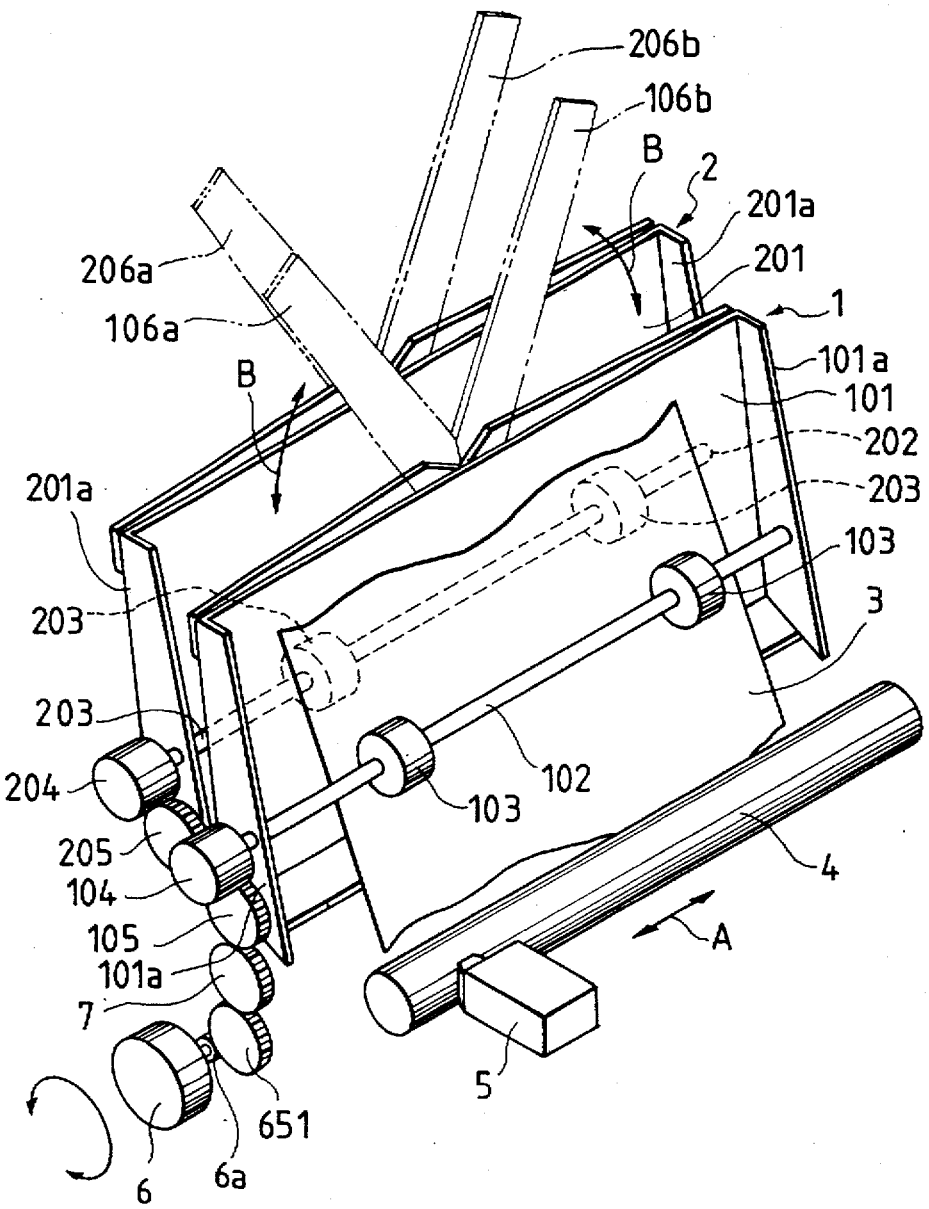
FIG. 1 is a schematic perspective view of an automatic sheet supplying apparatus according to a first embodiment of the present invention.

FIG. 1 is a schematic perspective view of an automatic sheet supplying apparatus according to a first embodiment of the present invention. In FIG. 1, a first tray 1 and a second tray 2 constitute a part of an automatic sheet feeder (referred to as "ASF" hereinafter) according to the first embodiment.

The ASF is provided with the first and second trays 1, 2 for containing recording sheets 3, respectively, and can be removably mounted on a recording apparatus. The recording apparatus includes a convey roller 4 for conveying the recording sheet 3, and a recording head 5 arranged in the vicinity of the convey roller 4 and adapted to form an image on the recording sheet 3. The recording head 5 can be reciprocally shifted along an axis of the convey roller 4 (shown by the arrow A). A drive motor 6 for generating a driving force to be transmitted to either one of drive transmitting systems associated with the first or second tray 1, 2 is arranged at a side of one end of the convey roller 4. A motor gear 6*a* secured to a drive shaft of-the drive motor 6 is drivingly connected to a transmission gear 7 via a transmission gear 51. The transmission gear 7 is disposed within the ASF, and the drive motor 6 and the gear train (between the motor and the gear 7) are disposed within the recording apparatus.

Now, explaining the first tray 1, the first tray 1 serves to supply the recording sheet 3 to the recording apparatus, and comprises a thin plate-shaped frame 101 for containing a plurality of recording sheets 3, a shaft 102 rotatably supported by a pair of opposed walls 101*a* which are formed by bending both ends of the frame 101, two sheet supply roller portions 103 (constituting a sheet supply roller) secured to the shaft 102 in a spaced relation, a first switching mechanism 104 attached to one end of the shaft 102 protruded outwardly from one of the walls 101*a*, and a transmission gear 105 for transmitting a driving force of the drive motor 6 to the first switching mechanism 104 through a gear train (described later) of the recording apparatus. A groove 102*a* (FIG. 4B) for engaging with a holder of the switching mechanism (described later) is formed on the shaft 102. Further, sheet supply paper supporters 106*a*, 106*b* for correcting postures of the recording sheets to be contained in the frame 101 are arranged behind the frame 101 so that the paper supporters 106*a*, 106*b* can be rotated in directions shown by the arrows B.

Next, the first switching mechanism 104 for the first tray 1 will be explained with reference to FIGS. 2 to 5.

Figure 2:
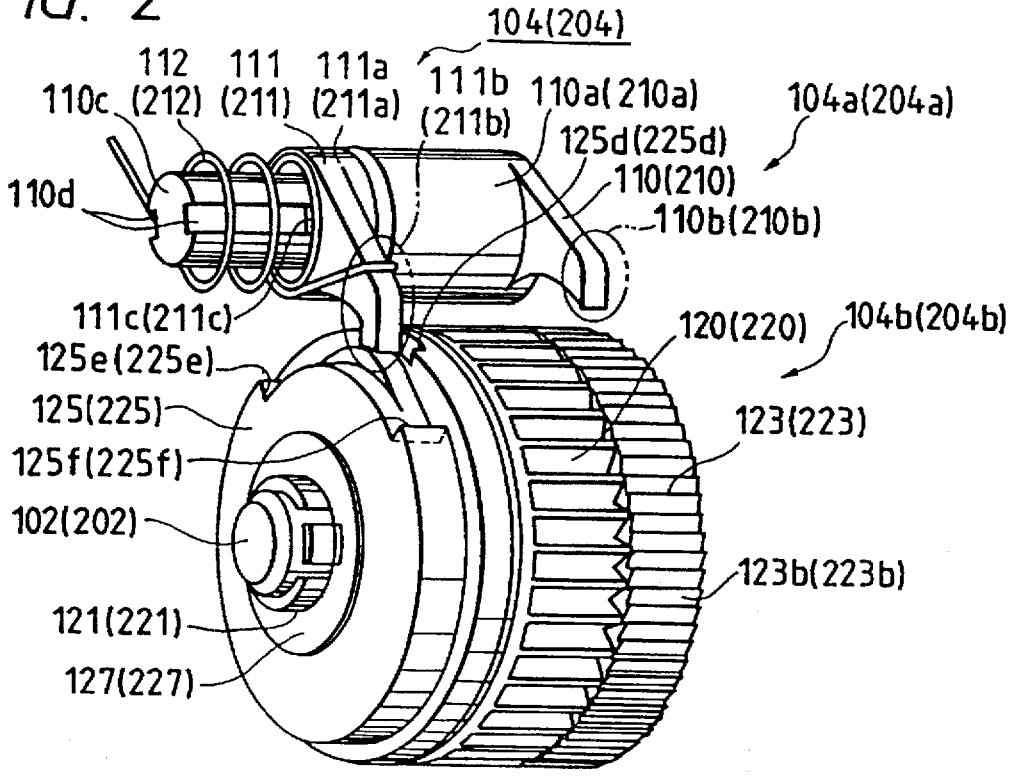
FIG. 2 is a perspective view of a first switching mechanism showing a condition that a first tray alone is selected.
Figure 3:
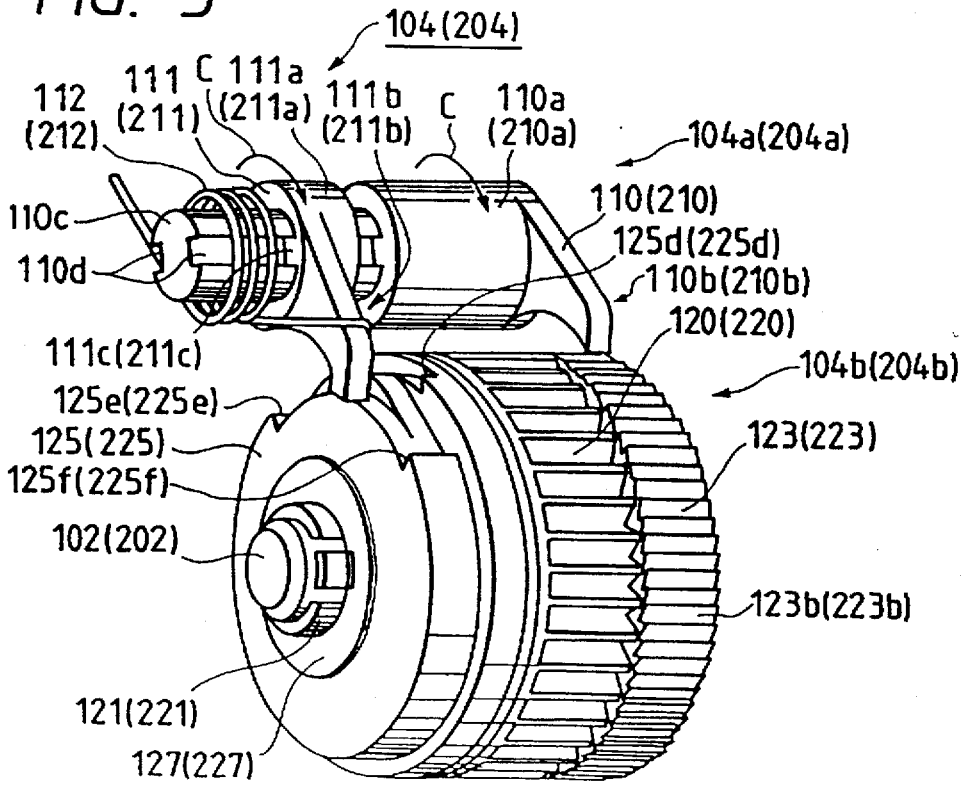
FIG. 3 is a perspective view of the first switching mechanism for the first tray, showing a condition that the first tray alone is not selected.
Figure 4A:
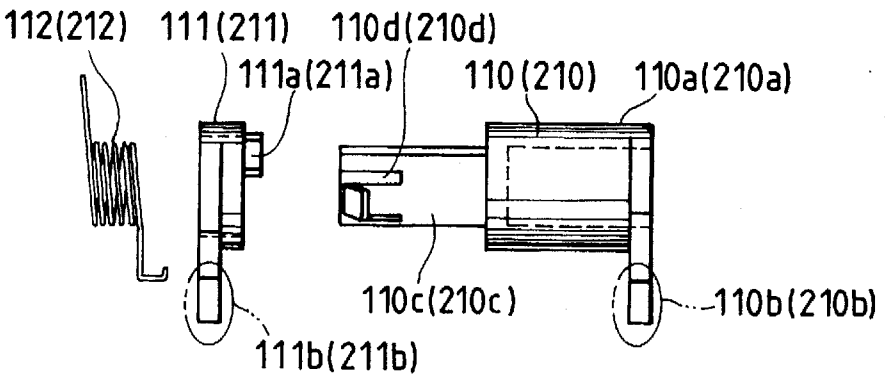
FIG. 4A is an exploded view of a control system of the first switching mechanism.
Figure 4B:
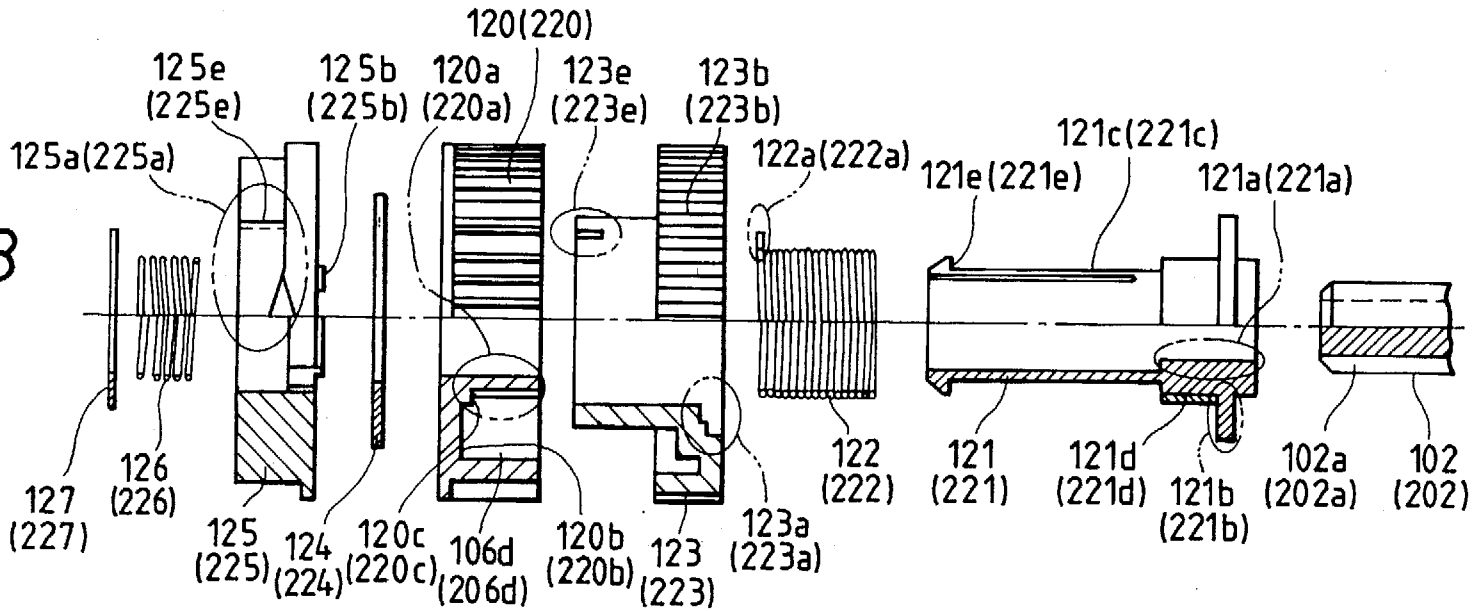
FIG. 4B is an exploded, in partial section, of a drive transmitting system of the first switching mechanism.
Figure 5:
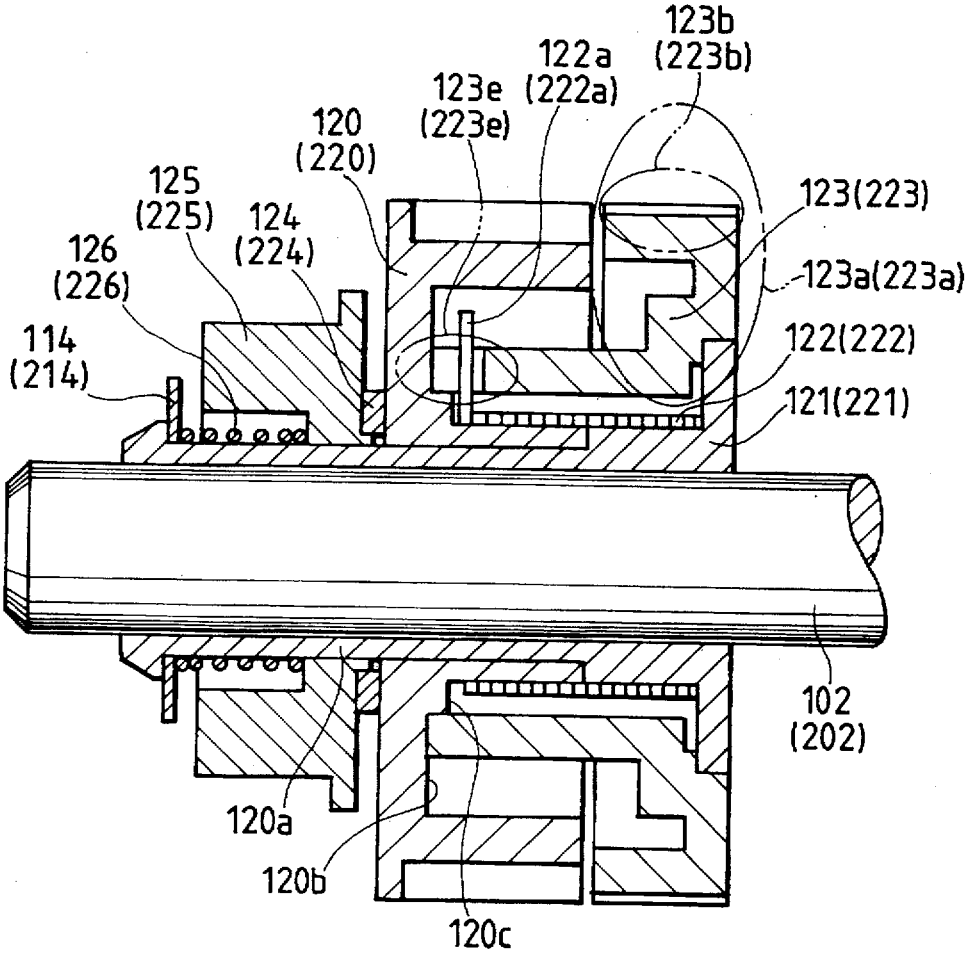
FIG. 5 is a sectional view of the drive transmitting system of the first switching mechanism.

FIG. 2 is a perspective view of the first switching mechanism showing a condition that the first tray alone is selected, FIG. 3 is a perspective view of the first switching mechanism for the first tray, showing a condition that the first tray alone is not selected, FIG. 4A is an exploded view of a control system 104*a* of the first switching mechanism, and FIG. 4B is an exploded, in partial section, of a drive transmitting system 104*b* of the first switching mechanism, and FIG. 5 is a sectional view of the drive transmitting system 104*b* of the first switching mechanism.

The first switching mechanism 104 for the first tray 1 comprises the control system 104*a*, and the drive transmitting system 104*b* controlled by the control system 104*a*. As shown in FIGS. 2 to 4B, the control system 104*a* comprises a ratch pawl 110 for regulating rotation of a control ring by engaging with a ratch portion of the control ring of the drive transmitting system which will be described later, a control pawl 111 for controlling engagement/disengagement between the ratch pawl 110 and the control pawl by being guided by a cam portion of a cam means (described later) of the drive transmitting system, and a torsion coil spring 112 for biasing the control pawl 111 toward the cam portion of the cam means.

The ratch pawl 110 comprises a substantially cylindrical large diameter body 110*a* rotatably attached to one of the walls 101*a* of the frame 101 of the first tray 1, a pawl portion 110*b* protruded from an outer surface of the body 110*a* near the wall 101*a* in a direction perpendicular to said outer surface, and a shaft portion 110*c* extending from an end of the body 110*a* opposite to said wall 101*a* in coaxial with the body 110*a* and having a diameter smaller than that of the body 110*a*. Two grooves 110*d* are formed in an outer peripheral surface of the shaft portion 110*c* along its longitudinal direction. On the other hand, the control pawl 111 comprises a bearing portion 111*a* for rotatably supporting the shaft portion 110*c* of the ratch pawl 110, a pawl portion 111*b* protruded from an outer surface of the bearing portion 111*a* toward a direction perpendicular to said outer surface, an engagement projection 111*c* protruded from an inner surface of the bearing portion 111*a* radially inwardly. The engagement projection 111*c* is engaged with the groove 110*d* of the ratch pawl 110 so that the control pawl 111 can be reciprocally shifted along a longitudinal direction of the shaft portion 110*c* of the ratch pawl 110.

The torsion coil spring 112 is wound around the shaft portion 110*c* of the ratch pawl 110 and has one end secured to one of the walls 101*a* of the frame 101 of the first tray 1 and the other end for always biasing the pawl portion 111*b* of the control pawl 111 toward a direction shown by the arrow C in FIG. 3 and biasing the control pawl 111 toward the body 110*a* of the ratch pawl 110.

On the other hand, as shown in FIGS. 2 to 5, the drive transmitting system 104*b* comprises a transmission gear 120 included in the first switching mechanism 104 and acting as an input site for receiving the driving force of the drive motor 6 through a gear train including the transmission gear 105, a holder 121 secured to the shaft 102 of the first tray 1 to be rotated together with the shaft 102, a spring clutch 122 urged against the holder 121 and the transmission gear 120 to transmit a rotational force of the transmission gear 120 to the shaft 102 of the first tray 1 via the holder 121, a control ring 123 for disengaging the spring clutch 122 from the transmission gear 120 and the holder 121 to prevent the rotational force of the transmission gear 120 from being transmitted to the shaft 102 of the first tray 1 by engaging with the pawl portion 110*b* of the ratch pawl 110, a cam means 125 for receiving the rotational force of the transmission gear 120 via a friction sheet 124, a coil spring 126 for biasing the cam means arranged in coaxial with the holder 121 toward the transmission gear 120, and a regulating plate 127 for regulating one end of the coil spring 126 to maintain a biasing force of the coil spring 126 acting on the cam means 125.

As shown in FIGS. 4B and 5, within the transmission gear 120, a bearing portion 120*a* for. rotatably supporting a holder which will be described later is arranged in coaxial with the transmission gear 120. The bearing portion 120*a* has a substantially cylindrical body around which an annular recess 120*b* for surrounding the bearing portion 120*a* is formed in coaxial with the bearing portion 120*a*, and a step or ridge 120*c* is formed on a corner between a bottom surface of the recess 120*b* and an outer peripheral surface of the bearing portion 120*a*.

As shown in FIGS. 4B and 5, the holder has a substantially cylindrical body provided at its central portion with a bearing portion for rotatably supporting the shaft 102 of the first tray 1, and an engagement projection 121*a* for engaging with a recess 102*a* of the shaft 102 is formed on an outer peripheral surface of the bearing portion. The periphery of the holder 121 includes a thin disc-like large diameter portion 121*b*, a substantially cylindrical small diameter portion 121*c*, and an intermediate diameter portion 121*d* disposed between the large and small diameter portions 121*b*, 121*c*. When the small diameter portion 121*c* is inserted into the bearing portion 120*a* of the transmission gear 120, a tip end of the bearing portion 120*a* is abutted against a step between the intermediate diameter portion 121*d* and the small diameter portion 121*c* so that the outer peripheral surface of the intermediate diameter portion 121*d* is flush with the outer peripheral surface of the bearing portion 120*a*. Further, a step 121*e* for holding the regulating plate 127 is formed on the end of the small diameter portion 121*c*.

As shown in FIGS. 4B and 5, the spring clutch 122 is wound around the outer peripheral surfaces of the intermediate diameter portion 121*d* and the bearing portion 120*a*. The spring clutch 122 is provided at its one end with a bent portion 122*a* which is engaged and locked by a notch of the control ring which will be described later.

A flange 123*a* of the control ring 123 is provided at its outer periphery with a ratch portion 123*b* by which the pawl portion 110*b* of the ratch pawl 110 is engaged, and the flange 123*a* is also provided at its inner periphery with a stepped portion 123*c* into which the large diameter portion 121*b* of the holder 121 is fitted. The inner periphery of the flange portion 123*a* inside of the stepped portion 123*c* defines a cylindrical portion 123*d* extending in an axial direction of the control ring 123, and a notch 123*e* for locking the bent portion 122*a* of the spring clutch 122 is formed in an end edge portion of the cylindrical portion 123*d*. Further, the end edge portion of the cylindrical portion 123*d* is abutted against the bottom surface of the annular recess 120*b* and the outer peripheral surface of the ridge 120*c* of the transmission gear 120 when the control ring 123 is mounted on the transmission gear 120.

The friction sheet 124 is a doughnut-shaped member fitted into the annular recess of the cam means 125 and fixed thereto. The cam means 125 has a substantially annular shape and includes a cam portion 125*a* formed on an outer periphery of the cam means and adapted to guide a pawl portion 111*b* of the control pawl 111 of the control system 104*a*, an annular recess 125*b* formed in an end face of the cam means near the transmission gear 120, for fittingly receiving the friction sheet 124, and an annular recess 125*c* formed in the cam portion 125*a*, for receiving the coil spring 126. As shown in FIGS. 2 and 3, the cam portion 125*a* has first, second and third locking portions 125*d*, 125*e*, 125*f*. The first locking portion 125*d* is formed on the outer peripheral surface of the cam means 125 near the annular recess 125*b*. The second and third locking portions 125*e*, 125*f* are formed on an outer peripheral surface having a diameter smaller than that of the aforementioned outer peripheral surface and are opposed to each other with the interposition of a communication passage. The third locking portion 125*f* is not opposed to the first locking portion 125*d*, but the second locking portion 125*e* is substantially opposed to the first locking portion 125*d* with offset.

The coil spring 126 is wound around the small diameter portion 121*c* of the holder 121 between the bottom surface of the annular recess 125*c* of the cam means 125 and the regulating plate 127. The regulating plate 127 is a ring-shaped member having an outer diameter greater than an inner diameter of the annular recess 125*c* of the cam means 125.

The construction of the first tray 1 as mentioned above is substantially the same as the construction of the second tray 2 except for a length of the cam portion 125*a*. Accordingly, explanation of the construction of the second tray 2 same as that of the first tray 1 will be omitted. However, various elements of the second tray corresponding to those of the first tray are designated by reference numerals greater than those for the first tray by one hundred in parentheses.

Incidentally, when the construction of the second tray 2 is understood with reference to FIGS. 1 to 5, FIG. 2 is regarded as a perspective view showing the condition of the second switching mechanism 204 when the second tray 2 alone is selected, and FIG. 3 is regarded as a perspective view showing the condition of the second switching mechanism 204 for the second tray 2 when the second tray 2 is not selected. Further, FIG. 4A is regarded as a view showing various elements of a control system 204*a* of the second switching mechanism 204, and FIG. 4B is regarded as a view showing various elements of a drive transmitting system 204*b* of the second switching mechanism 204. Further, FIG. 5 is regarded as a sectional view of the drive transmitting system 204*b*.

Now, explaining the difference between the cam portions between the first and second switching mechanisms 104, 204, in the illustrated embodiment, a distance between second and third locking portions 225*e*, 225*f* of a cam portion of the second switching mechanism 204 is set to be greater than a distance between the second and third locking portions 125*e*, 125*f* of the cam portion of the first switching mechanism 104. Due to this difference, the first tray 1 and the second tray 2 can be selected independently in accordance with a sequence which will be described later.

That is to say, the second switching mechanism 204 for the second tray 2 is designed so that it receives the driving force of the drive motor 6 of the recording apparatus from the transmission gear 105 of the first tray 1 via at least one transmission gear 205. Namely, the second switching mechanism 204 receives the driving force of the drive motor 6 through the drive transmitting system 104*b* of the first tray 1. In the second switching mechanism 204, when the driving force of the drive motor 6 is used in the first switching mechanism 104 in accordance with the predetermined sequence which will be described later, the driving force of the drive motor 6 is not transmitted to a shaft 202 of the second tray 2. Similarly, in the first switching mechanism 204, when the driving force of the drive motor 6 is used in the second switching mechanism 204 in accordance with the predetermined sequence which will be described later, the driving force of the drive motor 6 is not transmitted to the shaft 102 of the first tray 1.

Next, a sheet supplying operation when the sheet is supplied from the first tray 1 or the second tray 2 or when the sheet is supplied manually will be explained.

<Sheet supply from first tray>

The driving force of the drive motor 6 is transmitted to the transmission gear 120 of the drive transmitting system 104*b* of the first switching mechanism 104 via the gear train of the recording apparatus comprised of the motor gear 6*a* and transmission gear 651, and the transmission gears 7, 105 of the first tray 1, in accordance with the predetermined sequence which will be described later. In this case, in the second switching mechanism 204, since the pawl portion 210*b* of the ratch pawl 210 is engaged by the ratch portion 223*b* of the control ring 223, the driving force is not transmitted to the shaft 202. On the other hand, the driving force transmitted to the transmission gear 120 rotates the cam means 125 via the friction sheet 124. Since the pawl portion 111*b* of the control pawl 111 is urged against the cam portion 125*a* of the cam means 125 by the torsion coil spring 112, as the cam means 125 is rotated, the pawl portion 111*b* is shifted on the cam portion 125*a*, thereby rotating the control pawl 111. As a result, the ratch pawl 110 is also rotated in the same direction. Now, for example, when the pawl portion 111*b* of the control pawl 111 is shifted on the cam portion 125*a* from the first locking portion 125*d* to the second locking portion 125*e*, the slip is generated between the friction sheet 124 and the cam means 125 or between the friction sheet 124 and the transmission gear 120, thereby preventing the further rotation of the cam means in the same direction.

Then, when the drive motor 6 is rotated reversely, after the pawl portion 111*b* of the control pawl 111 is shifted on the cam portion 125*a* from the second locking portion 125*e* to the third locking portion 125*f*, the rotation of the drive motor 6 is again reversed, with the result that the pawl portion 111*b* is returned to a position in the vicinity of the first locking portion 125*d* as shown in FIG. 2. Consequently, the pawl portion 110*b* of the ratch pawl 110 rotated in the same direction as the control pawl 111 is disengaged from the ratch portion 123*b* of the control ring 123 of the drive transmitting system 104*b*, with the result that the driving force of the drive motor 6 is transmitted to the shaft 102 through the transmission gear 120, spring clutch 122 and holder 121, thereby driving the sheet supply roller 103 to supply the sheet from the frame 101 of the first tray 1 to the recording apparatus.

<Sheet supply from second tray>

As is in the first tray 1, the driving force of the drive motor 6 is transmitted to the transmission gear 120 in accordance with the predetermined sequence which will be described later. In this case, however, the driving force is also transmitted to the transmission gear 220 of the second switching mechanism 204 via the transmission gear 105 connected to the transmission gear 120 and the gear train including at least one transmission gear 205. In this case, in the first switching mechanism 104, since the pawl portion 110*b* of the ratch pawl 110 is engaged by the ratch portion 123*b* of the control ring 123, the driving force is not transmitted to the shaft 102. On the other hand, in the second switching mechanism 204, the driving force transmitted to the transmission gear 220 rotates the cam means 225 via the friction sheet 224. Since the pawl portion 211*b* of the control pawl 211 is urged against the cam portion 225*a* of the cam means 225 by the torsion coil spring 212 of the control system 204*a*, as the cam means 225 is rotated, the pawl portion 211*b* is shifted on the cam portion 225*a*, thereby rotating the control pawl 211. As a result, the ratch pawl 210 is also rotated in the same direction.

Now, for example, when the pawl portion 211*b* of the control pawl 211 is shifted on the cam portion 225*a* from the first locking portion 225*d* to the second locking portion 225*e*, the slip is generated between the friction sheet 224 and the cam means 225 or between the friction sheet 224 and the transmission gear 220, thereby preventing the further rotation of the cam means 225 in the same direction.

Then, when the drive motor 6 is rotated reversely, after the pawl portion 211*b* of the control pawl 211 is shifted on the cam portion 225*a* from the second locking portion 225*e* to the third locking portion 225*f*, the rotation of the drive motor 6 is again reversed, with the result that the pawl portion 211*b* is returned to a position in the vicinity of the first locking portion 225*d* as shown in FIG. 2. Consequently, the pawl portion 210*b* of the ratch pawl 210 is rotated in the same direction as the control pawl 211 is disengaged from the ratch portion 223*b* of the control ring 223 of the drive transmitting system 204*b*, with the result that the driving force of the drive motor 6 is transmitted to the shaft 202 through the transmission gear 220, spring clutch 222 and holder 221, thereby driving the sheet supply roller 203 to supply the sheet from the frame 201 of the second tray 2 to the recording apparatus.

<Manual insert>

Also in this case, the first and second switching mechanisms 104, 204 do not receive the driving force of the drive motor 6 in accordance with the predetermined sequence which will be described later.

Figure 6A:
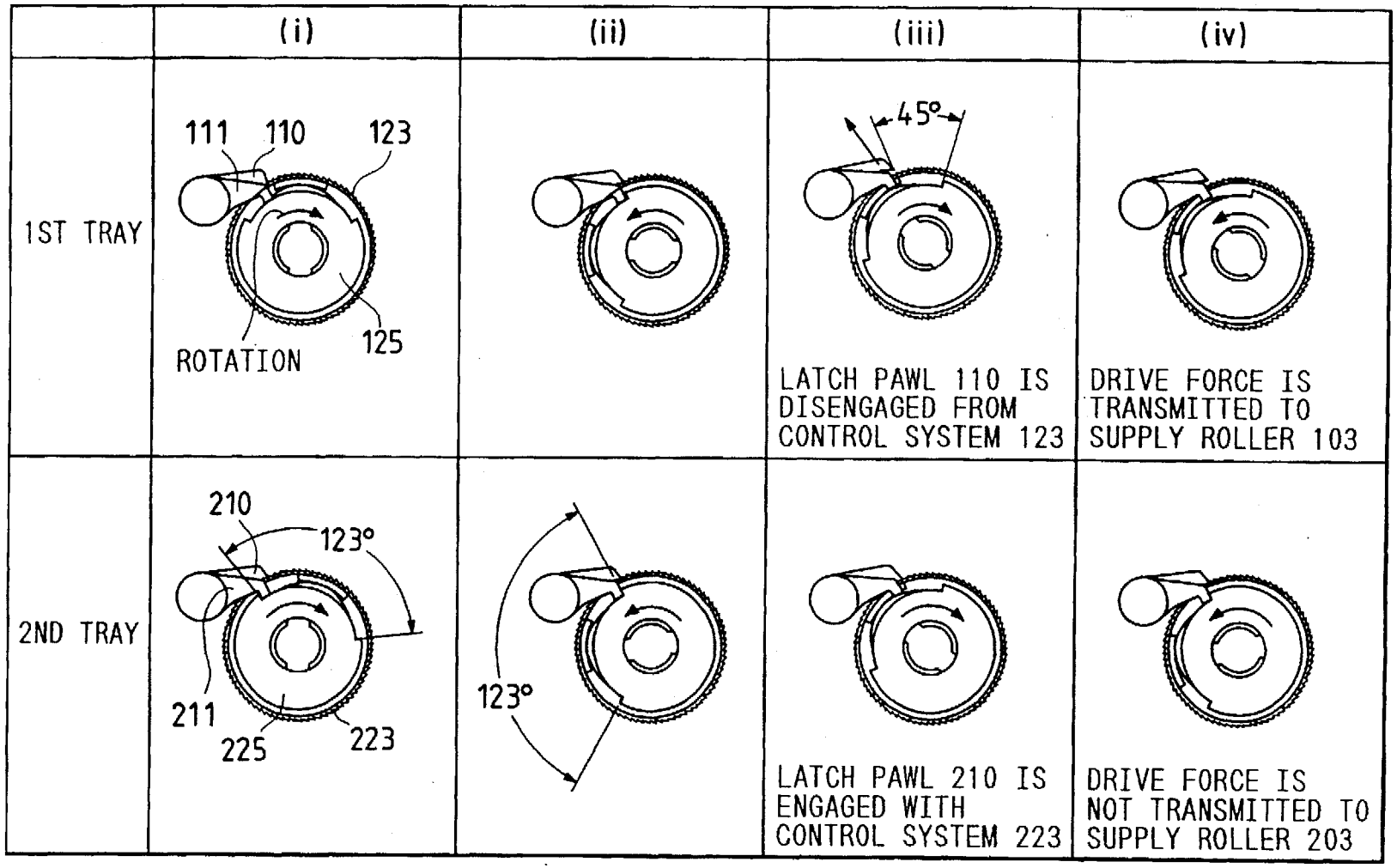
FIG. 6A is a view showing stages of an operational relation between a cam means and a control pawl and an operational relation between a ratch pawl operated in synchronous with the control pawl and a ratch portion of a control ring in the first embodiment shown in FIGS. 1 to 5.
Figure 6B:
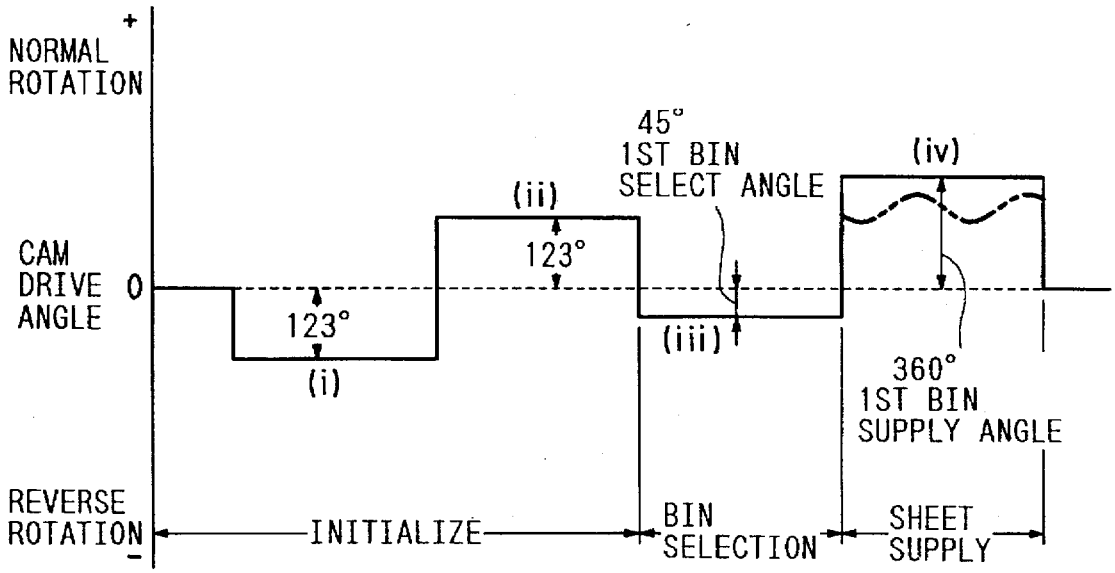
FIG. 6B is a graph showing the change in cam drive angle in the stages shown in FIG. 6A.
Figure 7B:
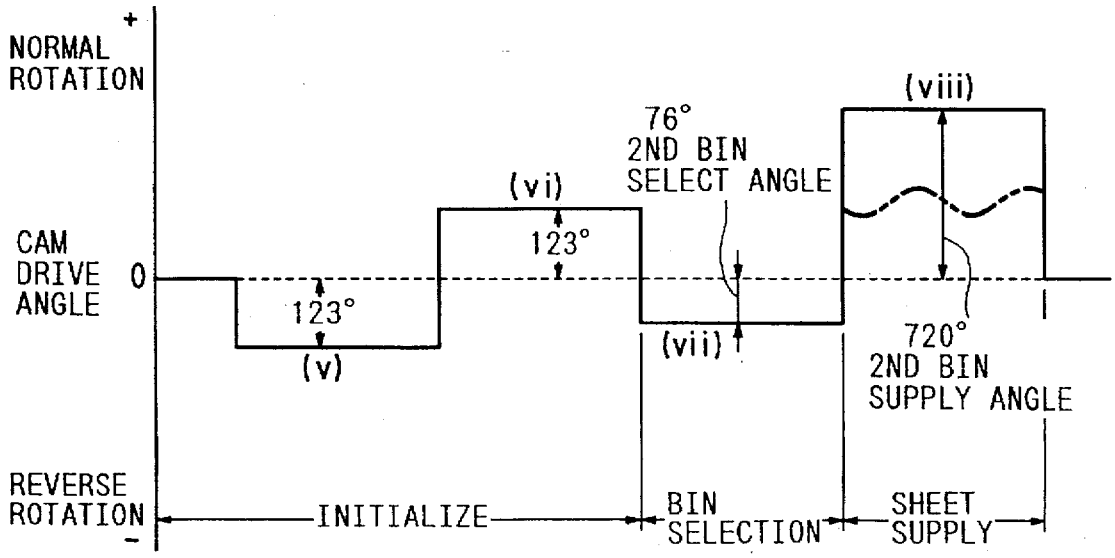
FIG. 7B is a graph showing the change in cam drive angle in the stages shown in FIG. 7A.
Figure 7A:
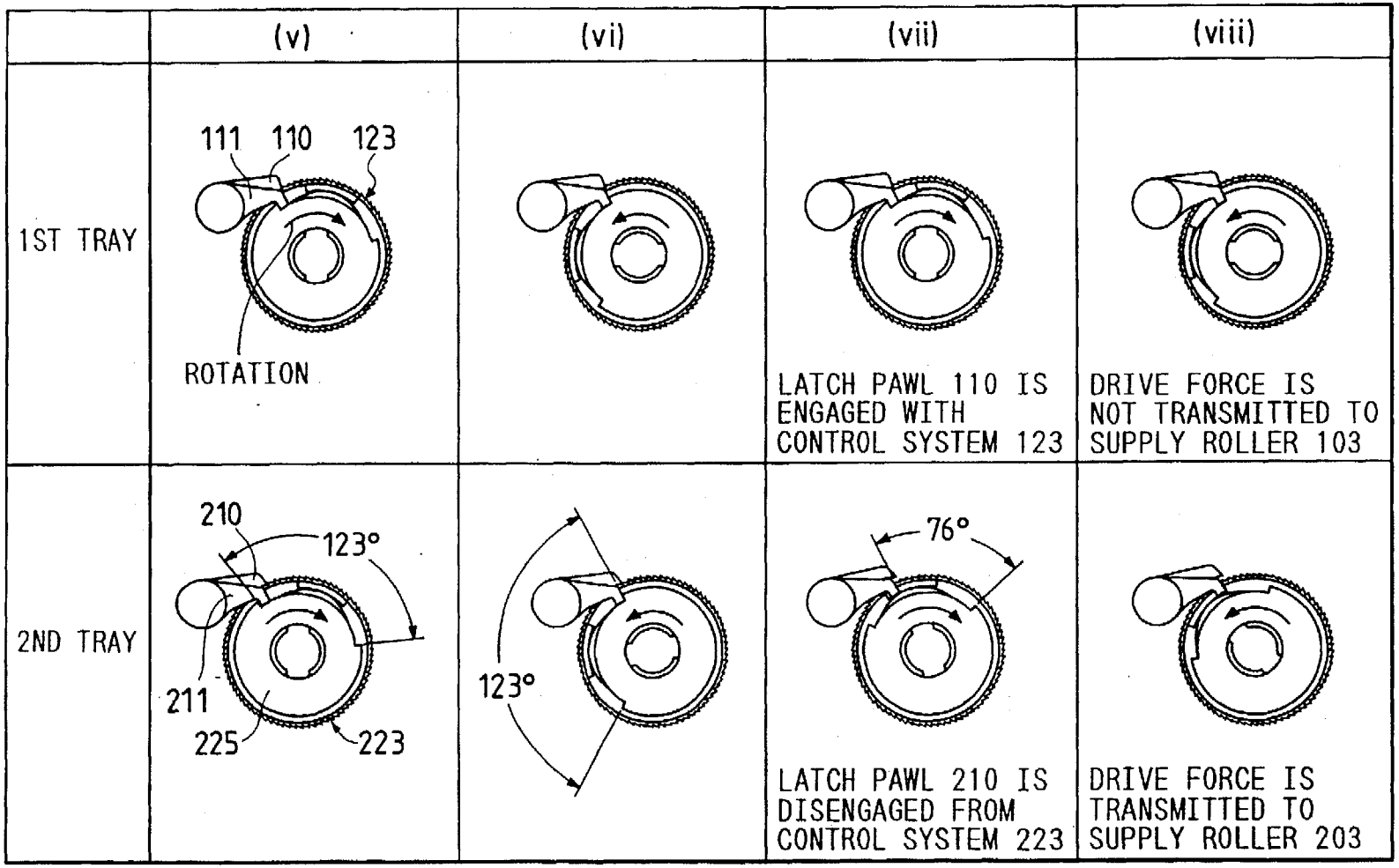
FIG. 7A is a view showing stages of an operational relation between a cam means and a control pawl and an operational relation between a ratch pawl operated in synchronous with the control pawl and a ratch portion of a control ring in the first embodiment shown in FIGS. 1 to 5.
Figure 8A:
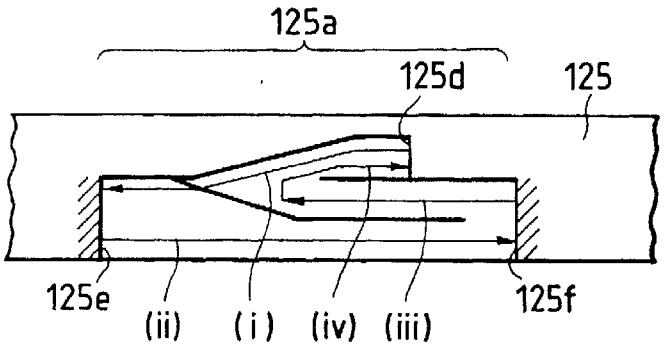
FIGS. 8A to 8D are schematic plan views of a cam portion of the cam means, where
Figure 8B:
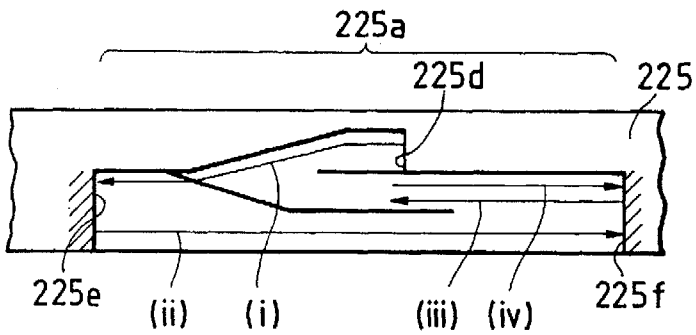
Figure 8C:
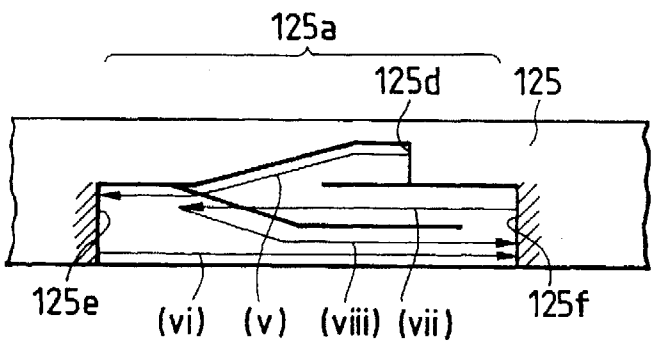
Figure 8D:
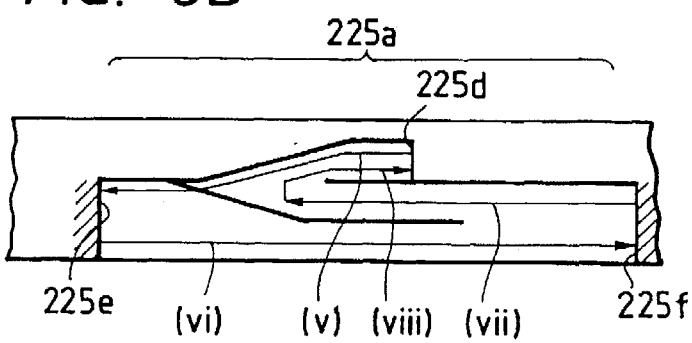
Figure 9:
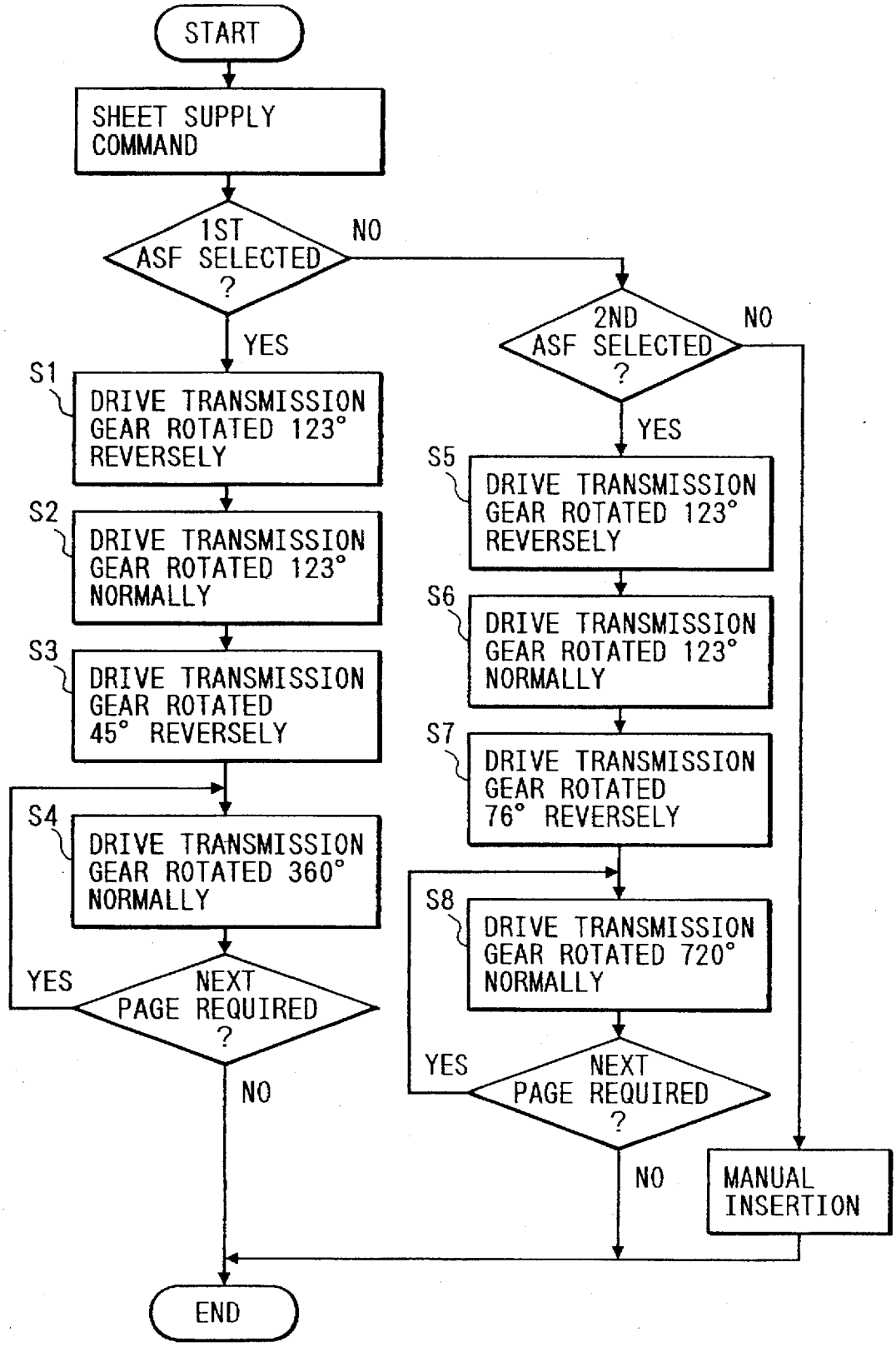
FIG. 9 is a flow chart showing a sequence according to the first embodiment.

Next, the sequence according to the illustrated embodiment will be explained with reference to FIGS. 6A to FIG. 6A is a view showing stages of an operational relation between the cam means and the control pawl and an operational relation between the ratch pawl operated in synchronous with the control pawl and the ratch portion of the control ring in the first embodiment shown in FIGS. 1 to 5, and FIG. 6B is a graph showing the change in cam drive angle in the stages shown in FIG. 6A. Further, FIG. 7A is a view showing stages of an operational relation between the cam means and the control pawl and an operational relation between the ratch pawl operated in synchronous with the control pawl and the ratch portion of the control ring in the first embodiment shown in FIGS. 1 to 5, and FIG. 7B is a graph showing the change in cam drive angle in the stages shown in FIG. 7A. FIGS. 8A to 8D are schematic plan views of the cam portion of the cam means, where FIG. 8A is a view showing a trace of the pawl portion of the control pawl slidingly driven on the cam portion when the first tray is selected, FIG. 8B is a view similar to FIG. 8A, showing the trace of the pawl portion of the control pawl slidingly driven on the cam portion when the first tray is selected, FIG. 8C is a view showing a trace of the pawl portion of the control pawl slidingly driven on the cam portion when the second tray is selected, and FIG. 8D is a view similar to FIG. 8C, showing the trace of the pawl portion of the control pawl slidingly driven on the cam portion when the second tray is selected. Further, FIG. 9 is a flow chart showing the sequence according to the illustrated embodiment. Incidentally, in FIGS. 6A to 7B, (i) to (viii) denote same conditions.

<Initialization>

Even when any tray is selected, the cam means is initialized. That is to say, for example, when the first tray 1 is selected, as shown in (i) in FIG. 6A, in the first switching mechanism 104, as the cam means 125 is rotated reversely (in a clockwise direction as shown) by 123 degrees, the pawl portion 111*b* of the control pawl 111 is abutted against the second locking portion 125*e* of the cam portion 125*a*, with the result that the pawl portion 110*b* of the ratch pawl 110 operated in synchronous with the control pawl 111 is fitted in the ratch portion 123*b* of the control ring 123, thereby preventing the driving force of the drive motor 6 from being transmitted to the shaft 102. In this case, in the second switching mechanism 204, the cam means 225 is rotated reversely by 123 degrees to abut the pawl portion 211*b* of the control pawl 211 against the second locking portion 225*e* of the cam portion 225*a*, thereby preventing the driving force of the drive motor 6 from being transmitted to the shaft 202.

Then, as shown in (ii), in the first switching mechanism 104, when the cam means 125 is rotated normally (in an anti-clockwise direction as shown) by 123 degrees, the pawl portion 111*b* of the control pawl 111 is abutted against the third locking portion 125*f* of the cam portion 125*a*, with the result that the driving force of the drive motor 6 is not transmitted to the shaft 102. In this case, also in the second switching mechanism 204, the cam means 225 is rotated normally by 123 degrees, with the result that the pawl portion 211*b* of the control pawl 211 is abutted against the third locking portion 225*f* of the cam portion 225*a* to prevent the driving force of the drive motor 6 from being transmitted to the shaft 202.

<selection of tray>

The selection of the first tray after the initialization is finished will be explained. As shown in (iii), when the cam means 125 is rotated (in a clockwise direction as shown) by 45 degrees, the pawl portion 111b of the control pawl 111 is shifted on the cam portion 125*a* from the third locking portion 125*f* to the position in the vicinity of the first locking portion 125*d* (FIG. 8A). When the pawl portion is shifted to this position, since the height of this position is the same as that of the first locking portion 125*d*, the control pawl 111 is pushed toward the transmission gear 120 by the biasing force of the torsion coil spring 112. Then, as shown in (iv), by rotating the cam means 125 slightly (in the clockwise direction as shown), the pawl portion 111*b* is locked by the first locking portion 125*d*. Further, the pawl portion 110*b* of the ratch pawl 110 operated in synchronous with the control pawl 111 is disengaged from the ratch portion 123*b* of the control ring 123 in the stage (iii), thereby transmitting the driving force of the drive motor 6 through the transmission gear 120 to the shaft 102 of the first tray 1. And, in the stage (iv), by rotating the transmission gear 120 by 360 degrees in the normal direction, the sheets in the first tray 1 are separated one by one and the separated sheet is supplied to the recording apparatus.

On the other hand, in the second switching mechanism 204, since the distance between the second and third locking portions 225*e*, 225*f* of the cam means 225 is greater than that of the first switching mechanism 104 (i.e., the circumferential distance between the second and third locking portions 225*e*, 225*f* is greater), even when the cam means is rotated by 45 degrees, the pawl portion 211*b* of the control pawl 211 does not reach the position in the vicinity of the third locking portion 255*f* (FIG. 8B). Accordingly, the pawl portion 210*b* of the ratch pawl 210 operated in synchronous with the control pawl 211 remains to be fitted into the ratch portion 223*b* of the control ring 223, with the result that the driving force of the drive motor 6 through the transmission gear 220 is not transmitted to the shaft 202 of the second tray 2.

Next, the selection of the second tray 2 will be explained.

First of all, since the initialization is the same as that of the first tray as shown in the stages (v), (vi), explanation thereof will be omitted.

After the initialization, when the cam means 125 is rotated reversely (in the clockwise direction as shown) by 76 degrees, as shown in (vii), (viii), the pawl portion 111*b* of the control pawl 111 of the first switching mechanism 104 is shifted from the third locking portion 125*f* to the higher position in the vicinity of the first locking portion 125*d*. However, since the rotational angle is great, it reaches the second locking portion 125*e* (FIG. 8C). Thus, in the first switching mechanism 104, the pawl portion 110*b* of the ratch pawl 110 remains to be fitted into the ratch portion 123*b* of the control ring 123, with the result that the driving force of the drive motor 6 is not transmitted to the shaft 102.

To the contrary, when the cam means 225 is rotated reversely (in the clockwise direction as shown) by 76 degrees, as shown in (vii), the pawl portion 211*b* of the control pawl 211 of the second switching mechanism 204 is shifted from the third locking portion 225*f* to the higher position in the vicinity of the first locking portion 225*d* (FIG. 8D). As a result, since the height of this position is the same as that of the first locking portion 225*d*, the control pawl 211 is urged toward the transmission gear 220 by the biasing force of the torsion coil spring 212. Then, as shown in (viii), by rotating the cam means 225 slightly in the normal direction (in the anti-clockwise direction as shown), the pawl portion 211*b* is locked by the first locking portion 225*d*. Further, the pawl portion 210*b* of the ratch pawl 210 operated in synchronous with the control pawl 211 is disengaged from the ratch portion 223*b* of the control ring 223 in the stage (vii), thereby transmitting the driving force of the drive motor 6 through the transmission gear 220 to the shaft 202 of the second tray 2. In the stage (viii), by rotating the transmission gear 220 by 720 degrees in the normal direction, the sheets in the second tray 2 are separated one by one and the separated sheet is supplied to the recording apparatus.

The drive motor 6 according to the illustrated embodiment can also act as a drive source for driving a suction pump of a discharge recovery means to be provided in the recording apparatus when the recording head is an ink jet recording head. Now, the application of the drive motor 6 to the drive source for the suction pump will be explained with reference to FIGS. 10 to 12.

Figure 10:
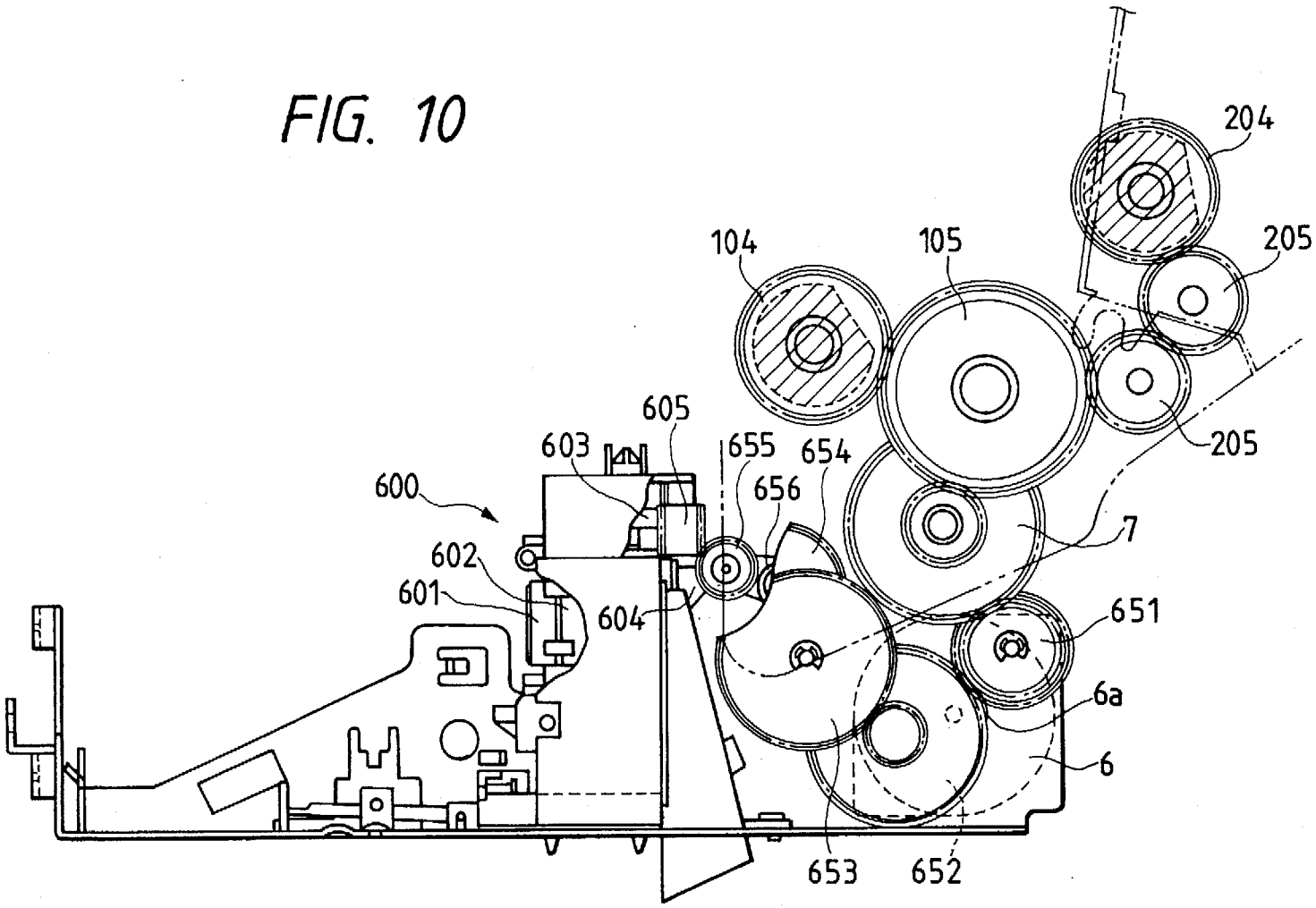
FIG. 10 is a side view showing a recovery system, drive sources for the recovery system and an ASF, and a transmission gear train.

In FIG. 10, a recovery system 600 for the ink jet recording head includes a cap 601 for closely contacting with a discharge surface of the recording head to prevent the drying of nozzles, and a suction pump 602 for removing dust or bubbles accumulated in liquid passages in the recording head by sucking ink from the nozzles by negative pressure in a condition that the cap 600 is closely contacted with the recording head. A piston shaft (not shown) is provided within the suction pump 602 so that the negative pressure can be created by driving a cam 603. Further, the recovery system 600 includes a blade member (not shown) made of rubber for removing the ink droplets and dust from the discharge opening and therearound of the recording head, and ink absorbing member or tank (not shown) for receiving the ink discharged by recovery discharge (preliminary discharge).

Regarding the recovery system 600, the driving force is transmitted to an input gear 604 of the recovery system from the drive motor 6 through the motor gear 6*a*, transmission gears 651, 652, 653 and 654 and pendulum gear 655, as shown in FIG. 10, and then is transmitted to the cam 603 through a transmission gear 605 of the recovery system, thereby driving the cam 603.

Incidentally, when the ASF is mounted on the recording apparatus, the transmission gear 651 is connected to the transmission gear 7 of the ASF, thereby permitting the selection of the first or second tray 1, 2 and the rotation of the sheet supply roller.

Figure 11:
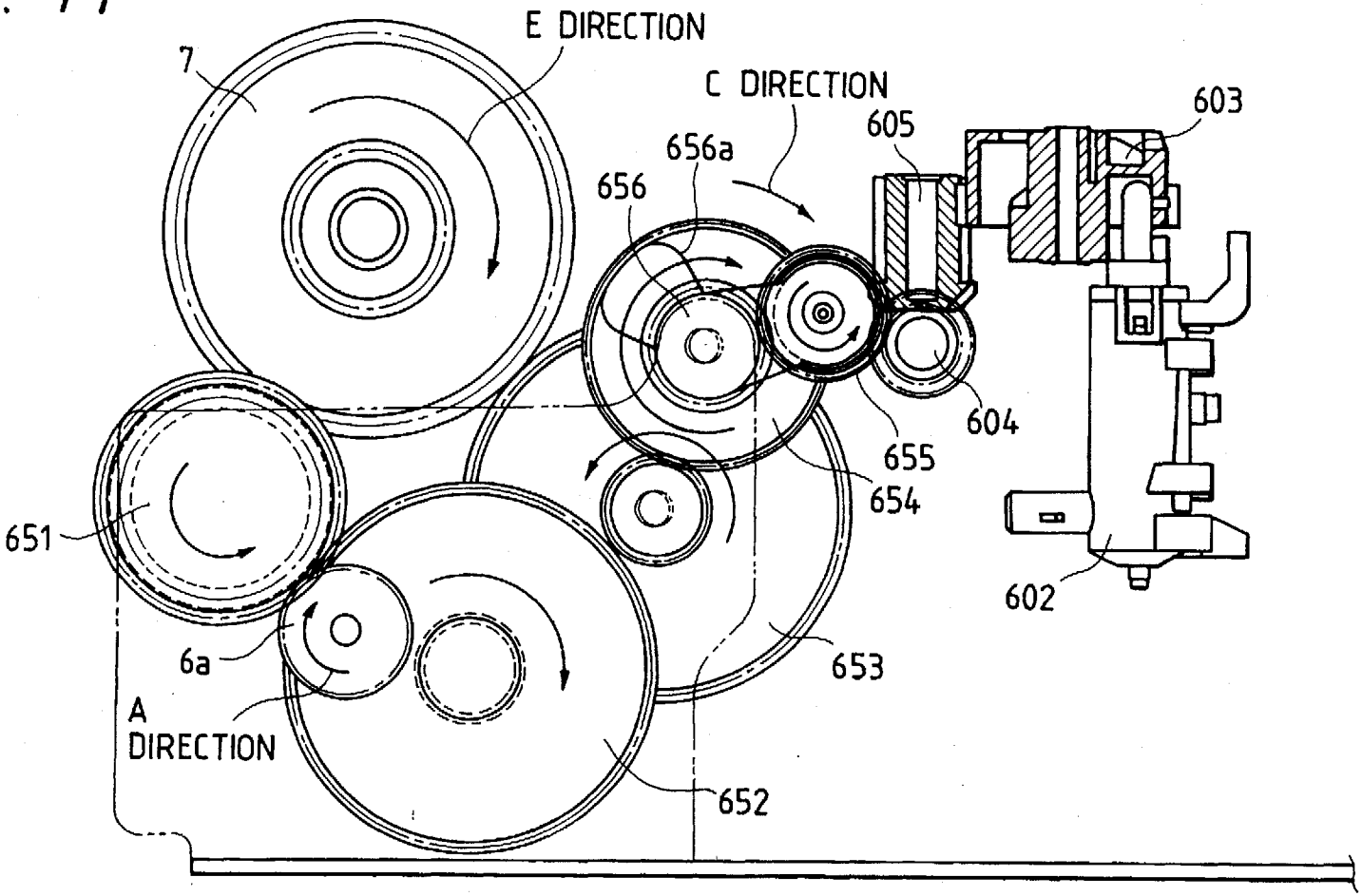
FIG. 11 is a side view showing a condition that a driving force is transmitted to the recovery system.
Figure 12:
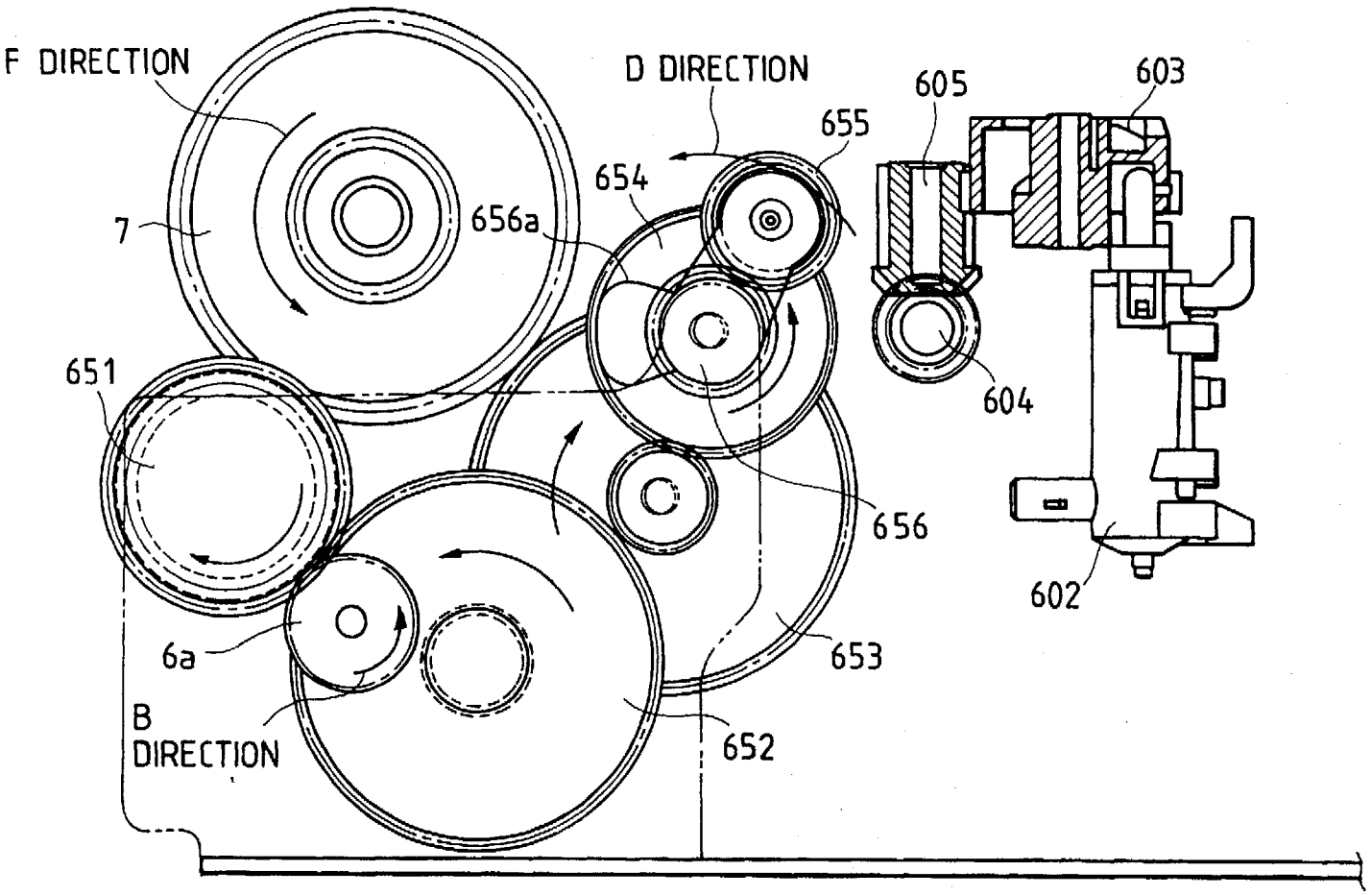
FIG. 12 is a side view showing a condition that the driving force is not transmitted to the recovery system.

Next, the connection/disconnection of the driving force with respect to the recovery system 600 will be explained. FIG. 11 is a side view showing a condition that the driving force is connected to the recovery system 600, and FIG. 12 is a side view showing a condition that the driving force is disconnected from the recovery system 600.

<Connection of the driving force to the recovery system 600>

When the drive motor 6 is rotated in a direction (clockwise direction) shown by the arrow A in FIG. 11, a pendulum 656 on which the pendulum gear 655 drivingly connected to the transmission gear 654 via a gear train is mounted is rotated in a direction (clockwise direction) shown by the arrow C together with the transmission gear 654 due to a friction action, thereby transmitting the driving force to the recovery system input gear 604. In this case, since the transmission gear 7 meshed with the transmission gear 651 is rotated in a direction (clockwise direction) shown by the arrow E, in the switching mechanisms of the trays, the condition (i) shown in FIG. 6A or the condition (v) shown in FIG. 7A is attained so that the driving force is not transmitted to the trays.

To the contrary, when the motor gear 6*a* of the drive motor 6 is rotated in a direction (anti-clockwise direction) shown by the arrow B, since the pendulum gear 655 rotated together with the transmission gear 654 in a direction (anti-clockwise direction) shown by the arrow D, the driving force is disconnected from the recovery system. In this case, the transmission gear 7 of the ASF is rotated in the direction (clockwise direction) shown by the arrow E, thereby permitting the selection of the tray or the sheet supplying operation.

Accordingly, in the illustrated embodiment, the driving force is transmitted to the recovery system 600 only when the drive motor 6 as the drive source is rotated in the direction A in FIG. 11, and, when the drive motor is rotated in the direction B, the driving force is not transmitted to the recovery system. However, when the pendulum gear 655 continues to rotate in the direction D, since a locking portion 656*a* of the pendulum gear 655 is abutted against a chassis to stop the pendulum gear, even when the drive motor 6 is rotated in the direction B continuously, there is no problem. Further, when the tray is selected, although the motor gear 6*a* is rotated in the direction A in FIG. 11, since the driving amount of the drive motor 6 in the selection of the tray is set so that the pendulum gear 655 is not connected to the recovery system input gear 604, there is no interference with each other.

[Second Embodiment]

Next, an ASF according to a second embodiment of the present invention will be explained with reference to FIGS. 13 to 18.

Figure 13:
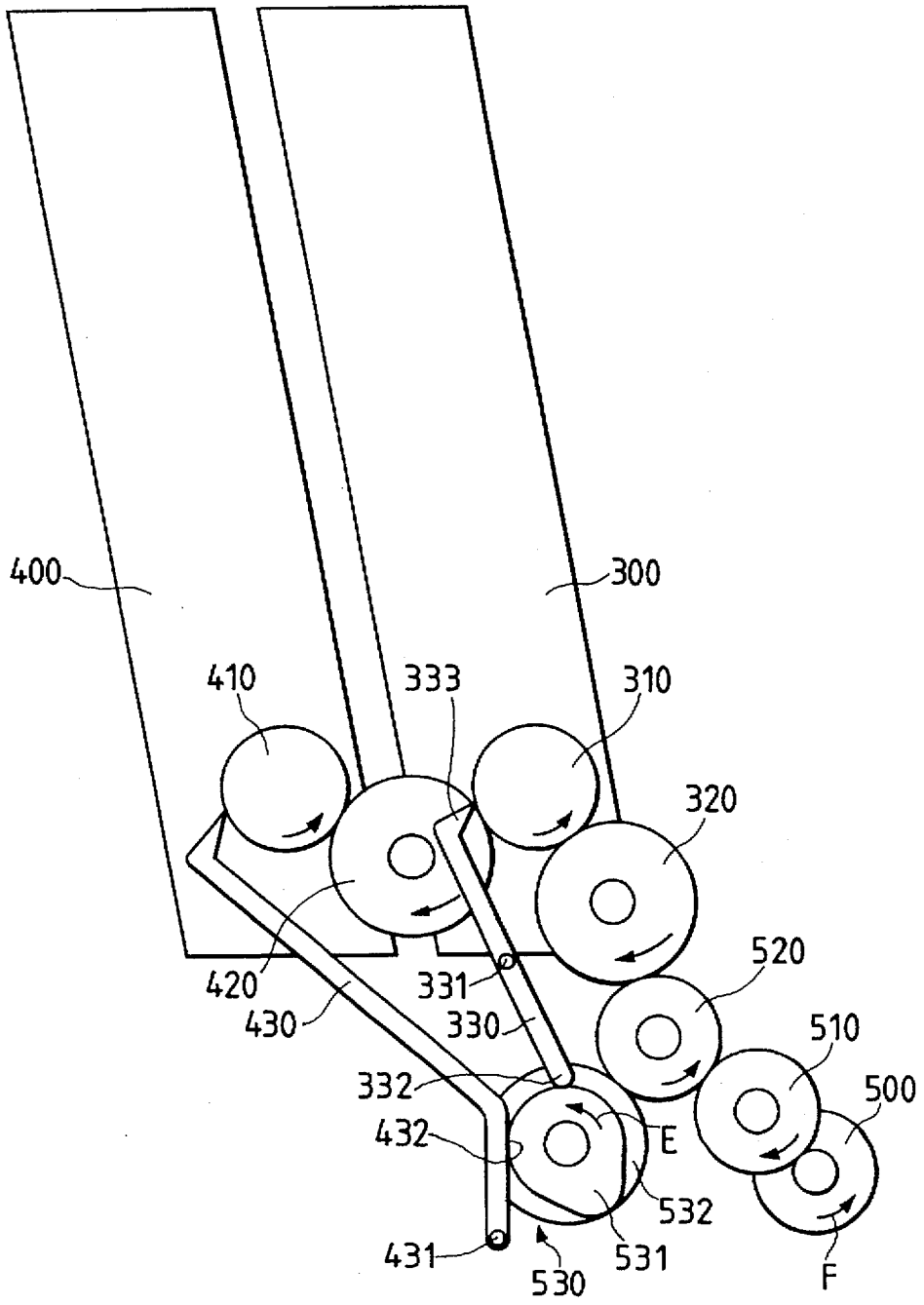
FIG. 13 is a schematic side view showing a gear train including a switching clutch mechanism, according to a second embodiment of the present invention.
Figure 14:
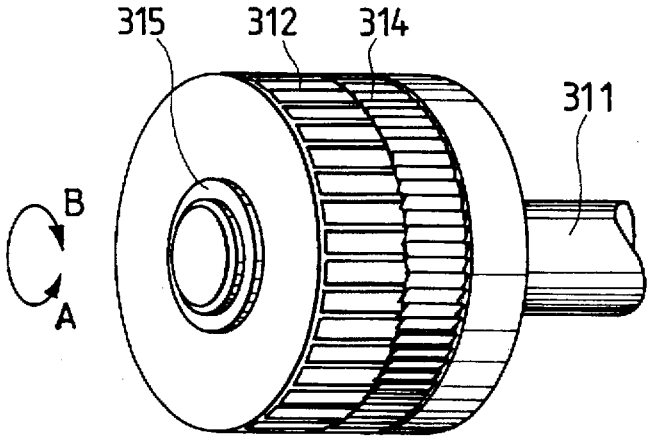
FIG. 14 is a perspective view of the switching clutch mechanism of FIG. 13.
Figure 15:
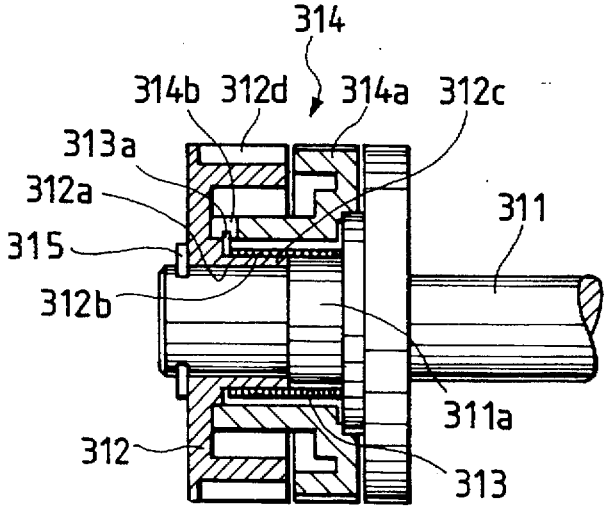
FIG. 15 is a sectional view of the switching clutch mechanism of FIG. 14, showing an inner structure thereof.
Figure 16:
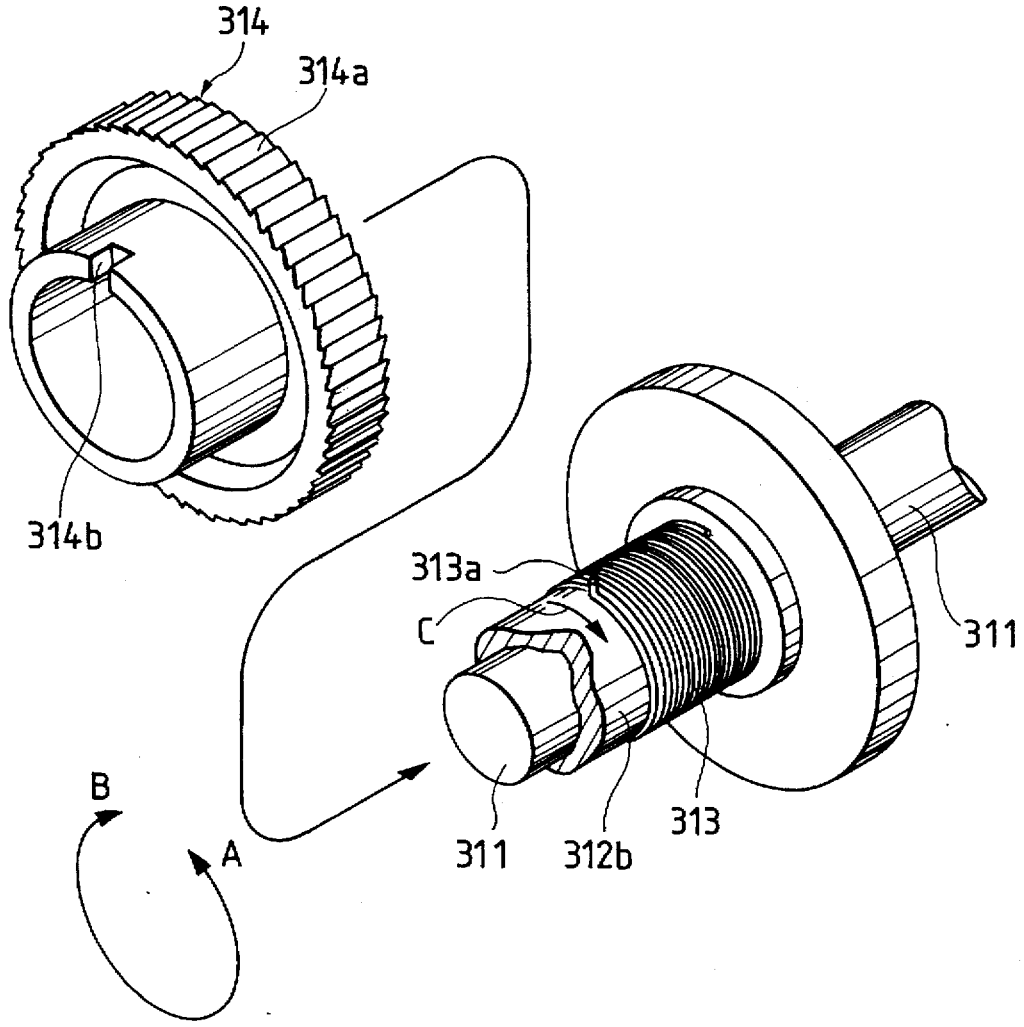
FIG. 16 is an exploded perspective view showing elements forming a part of the switching clutch mechanism of FIGS. 13 and 14.
Figure 17:
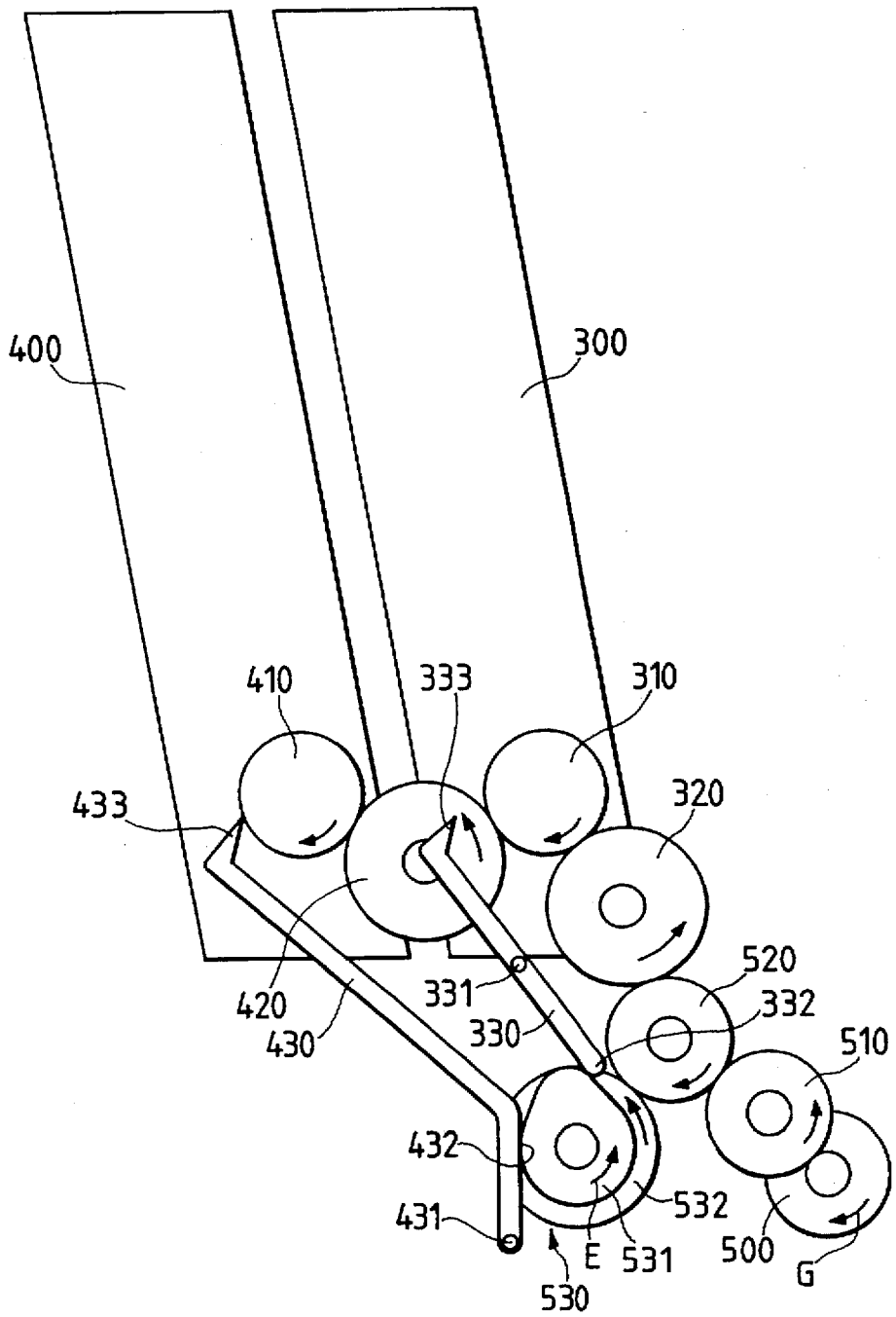
FIG. 17 is a view of the gear train of FIG. 13, showing a condition that sheets are supplied from only the first tray.
Figure 18:
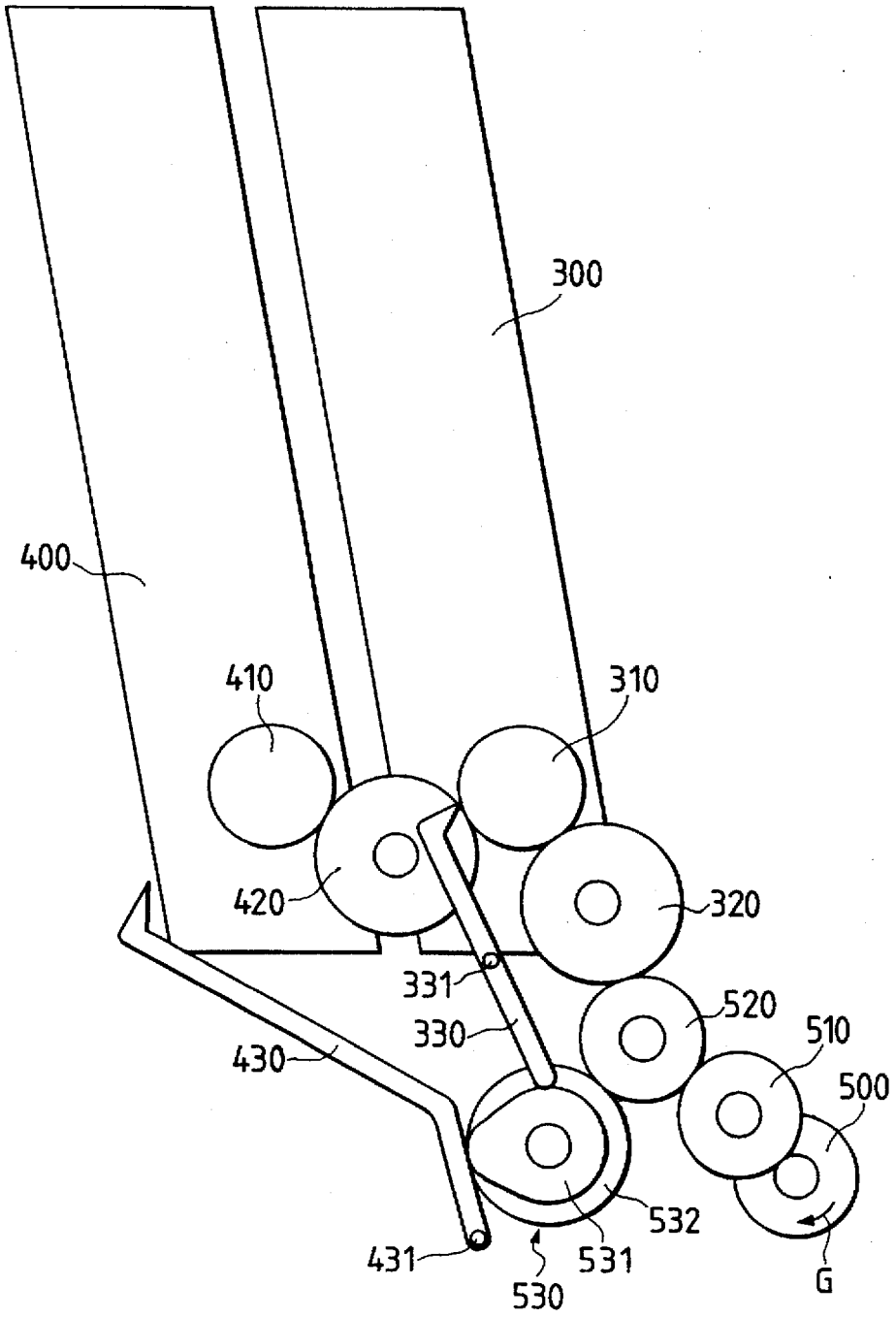
FIG. 18 is a view of the gear train of FIG. 13, showing a condition that sheets are supplied from only the second tray.

FIG. 13 is a schematic side view showing a gear train including a switching clutch mechanism, according to a second embodiment of the present invention, FIG. 14 is a perspective view of the switching clutch mechanism of FIG. 13, FIG. 15 is a sectional view of the switching clutch mechanism of FIG. 14, showing an inner structure thereof, FIG. 16 is an exploded perspective view showing elements forming a part of the switching clutch mechanism of FIGS. 13 and 14, FIG. 17 is a view of the gear train of FIG. 13, showing a condition that sheets are supplied from only the first tray, and FIG. 18 is a view of the gear train of FIG. 13, showing a condition that sheets are supplied from only the second tray.

In these Figures, the reference numeral 300 denotes a frame of a first tray; 310 denotes a first switching mechanism (also referred to as "clutch mechanism" hereinafter); 320 denotes a gear for transmitting a driving force to the first switching mechanism 310; and 330 denotes a first control lever rotatably mounted on a shaft 331 secured to the frame 300. Further, one end 322 of the control lever 330 is slidingly shifted on a cam surface 531 of a control cam 530, and the other end of the control lever has a pawl portion 333 which is engaged by a ratchet portion of the switching clutch mechanism 310 which will be described later. The end 322 of the control lever 330 is biased toward the cam 531 by a spring (not shown).

Further, the reference numeral 400 denotes a frame of a second tray; 410 denotes a second control clutch mechanism (also referred to as "clutch mechanism" hereinafter); 420 denotes a transmission gear for transmitting a driving force from the first switching mechanism 310 to the second control clutch mechanism 410; and 430 denotes a second control lever rotatably mounted on a shaft 431 secured to the frame 400. Further, a sliding surface 432 of the control lever 430 is slidingly shifted on the cam surface 531 as is in the first control lever 330, and the other end of the control lever has a pawl portion 433 which is engaged by a ratchet portion of the second control clutch mechanism 410 which will be described later. The second control lever 430 is biased toward the cam 531 by a spring (not shown).

Further, the reference numeral 500 denotes a drive motor; 510 denotes a motor gear; and 520 denotes an idler gear. The control cam 530 comprises the aforementioned cam portion 531 and a gear portion 532. The cam portion 531 and the gear portion 532 are connected to each other by a one-way clutch (not shown) so that the cam portion 531 is rotated only in a direction shown by the arrow E.

Next, the first clutch mechanism 310 will be explained with reference to FIGS. 14 and 15.

In FIGS. 14 and 15, a shaft 311 extends through the frame 300, and a sheet supply roller (not shown) is secured to the shaft 311. An input gear 312 has a central hole 312*a* through which the shaft 311 extends, a shaft portion 312*b* for mounting a control ring 314 thereon, an abutment surface 312*c* provided on an end of the shaft portion 312*b* for abutting against the shaft 311, and a gear portion 312*d* engaged by the first and second transmission gears 320, 420. A spring clutch 313 is wound around a stepped portion 311*a* of the shaft 311 and the shaft portion 312*b* of the input gear 312. Further, an end of the spring clutch 313 near the input gear 312 is provided with a bent portion 313*a*. The control ring 314 serves to control ON/OFF of the spring clutch 313 and is provided at its outer periphery with a ratchet portion 314*a*. A recess 314*b* for receiving the bent portion 313*a* of the spring clutch 313 is formed in an end of the control ring 314 near the input gear 312. An E-ring 315 serves secure the input gear 312, spring clutch 313 and control ring 314 to the shaft 311 to prevent them from disconnecting from the shaft 311.

Now, the spring clutch 313 and the control ring 314 will be fully explained with reference to FIG. 16. The spring clutch 313 is wound around the stepped portion 311*a* of the shaft 311 and the shaft portion 312*b* of the input gear 312 with predetermined interference. The "interference" means a distance between an inner diameter of the spring clutch 313 and outer diameter of the stepped portion 311*a* of the shaft 311 and the shaft portion 312*b* of the input gear 312 when such outer diameters are set to be greater than such inner diameter. When the inner diameter of the spring clutch 313 is d and the outer diameter of the stepped portion 311*a* of the shaft 311 is D, the interference Δ indicated by $\Delta=D-d$, and, in the illustrated embodiment, the interference Δ is set to 0.5 mm. A winding direction of the spring of the spring clutch 313 is a clockwise direction shown by the arrow C in FIG. 16. The control ring 314 is mounted around the spring clutch 313 with the recess 314*b* engaged by the bent portion 313*a* of the spring slutch 313. That is to say, as is in the first embodiment, this mechanism constitutes a one-way clutch utilizing the spring clutch, wherein, when the input gear 312 is rotated in a direction shown by the arrow A in FIG. 16, the rotational force of the input gear is transmitted to the shaft 311, but, when the input gear is rotated in a direction shown by the arrow B in FIG. 16, the rotational force of the input gear is transmitted to the shaft 311. When the input gear 312 is rotated in a direction A to transmit the rotational force to the shaft 311, since the spring clutch 313 is also rotated in synchronous with the input gear 312, the control ring 314 is also rotated. When a force for stopping the control ring 314 is applied to the control ring, the control ring 314 is stopped, and at the same time, a force directing toward the direction C is applied to the bent portion 313*a* of the spring clutch 313, thereby loosening the spring clutch to increase the diameter thereof. As a result, the rotational force of the input gear 312 is not transmitted to the shaft 311. That is to say, as is in the first embodiment, this clutch mechanism 310 can be turned ON or OFF by the control ring 314. A condition that the control ring 314 is free (i.e., rotatable) and the rotational force of the spring clutch 313 can be transmitted is referred to as "clutch ON" condition, and a condition that the control ring 314 is stopped and the rotational force of the spring clutch 313 cannot be transmitted is referred to as "clutch OFF" condition.

Since the construction of the second clutch mechanism 410 is the same as that of the first clutch mechanism 310, explanation thereof will be omitted.

Next, the operation of the second embodiment will be explained with reference to FIGS. 13, 17 and 18.

FIG. 13 shows a condition that the sheet cannot be supplied from the first and second trays. That is to say, when the drive motor 500 is rotated in a direction shown by the arrow F in FIG. 13, the input gear 312 of the dirt clutch mechanism 310 is rotated in the direction A in FIG. 16 via the motor gear 510, idler gear 520 and the first transmission gear 320. In this case, although the shaft 311 tries to rotate via the spring clutch 313, since the ratch portion 314*a* of the control ring 314 is locked by the pawl portion 333 of the control lever 330, the spring clutch 313 becomes the OFF condition, with the result that the rotational force is not transmitted to the shaft 311, and, thus, the sheet supply roller (not shown) is not rotated. On the other hand, the rotation of the input gear 312 is transmitted to the second clutch mechanism 410 via the second transmission gear 420 meshed with the input gear 312. However, as is in the first clutch mechanism 310, since the ratch portion 414*a* of the control ring 414 of the second clutch mechanism 410 is locked by the control lever 430, the second clutch mechanism 410 becomes the OFF condition, with the result that the sheet supply roller (not shown) is not rotated.

Next, an operation for selecting the first tray will be explained.

As shown in FIG. 17, when the drive motor 500 is rotated in a direction G opposite to the direction F in FIG. 13, the rotational force of the drive motor is transmitted to the gear portion 532 of the control cam 530 through the motor gear 510 and idler gear 520. Since the rotational direction of the motor is the rotation transmitting direction of the one-way clutch, the cam 531 is rotated in a direction shown by the arrow E. When a predetermined amount of rotation is finished, the cam portion 531 pushes the sliding surface 322 of the control lever 330 upwardly, thereby rotating the control lever, with the result that the ratch portion 314*a* of the control ring 314 is released from the pawl portion 333. In this case, although the first and second clutch mechanisms 310, 410 are also rotated via the first and second transmission gears 320, 420, since the rotational directions thereof correspond to the direction B, the rotational forces are not transmitted to the shafts 311, 411.

Now, when the drive motor 500 is rotated in the direction F (anti-clockwise direction), since the ratch portion 314*a* of the control ring 314 is released from the pawl portion 333 and the first clutch mechanism 310 becomes the ON condition, the rotational force is transmitted from the input gear 312 to the shaft 311, thereby rotating the sheet supply roller (not shown).

Next, an operation for selecting the second tray will be explained.

From the condition shown in FIG. 17, when the drive motor 500 is rotated in the direction G (clockwise direction), the control lever 430 is rotated by the cam portion 531 of the control cam 530. As a result, the pawl portion 433 of the control lever 430 is disengaged from the ratch portion 414*a* of the control ring 414, thereby bringing the second clutch mechanism 410 to the ON condition. When, the drive motor 500 is rotated normally in the anti-clockwise direction, the sheet supply roller of the second tray is rotated, thereby supplying the sheet from the second tray to the recording apparatus. On the other hand, as shown in FIG. 18, since the lifted control lever 330 of the first tray is returned to the original position and the ratch portion 314*a* of the control ring 314 is locked by the pawl portion 333, the first clutch mechanism 310 becomes the OFF condition, thereby preventing the sheet supply from the first tray.

As mentioned above, in the illustrated embodiment, the first of second tray can easily be selected by rotating the drive motor in the reverse direction by the predetermined amount, and thereafter, the sheet can be supplied from the selected tray by rotating the drive motor in the normal direction. Accordingly, the sheet supply source (tray) can be selected without using the expensive elements such as electromagnetic clutches unlike to the conventional cases, and, even if the number of the trays is increased, the countermeasure can easily be attained by changing the phases of the cams. Further, as in the first embodiment, the driving force of the drive motor can be used to drive other systems such as the recovery system.

Next, an embodiment of a recording apparatus on which the above-mentioned ASF can be mounted will be explained with reference to FIGS. 19 to 21.

Figure 19:
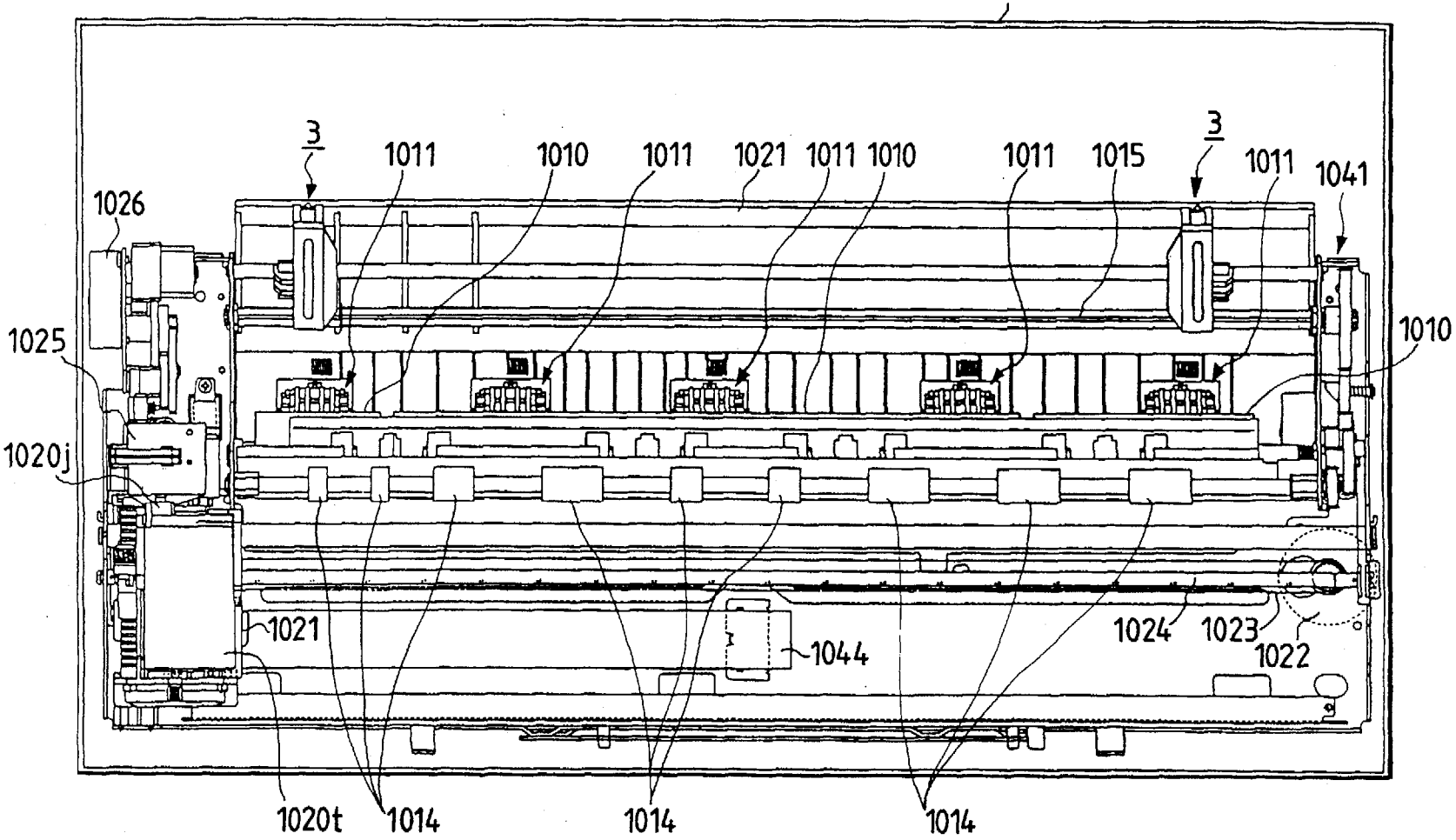
FIG. 19 is a plan view of an ink jet recording apparatus according to a first embodiment of the present invention.
Figure 20:
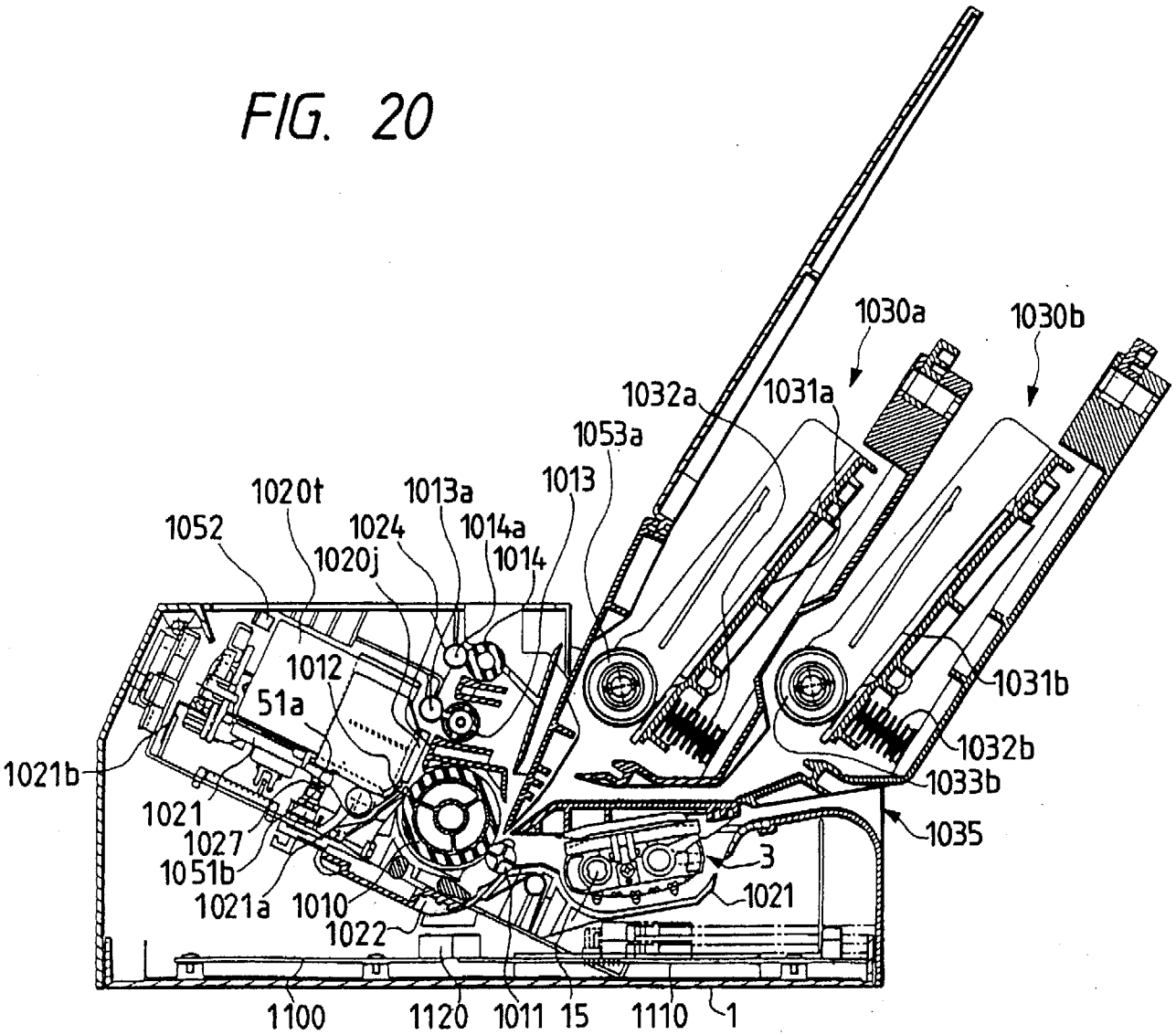
FIG. 20 is a side sectional view of the ink jet recording apparatus on which the ASF is mounted.

FIGS. 19 and 20 show an ink jet recording apparatus according to a first embodiment of the present invention, and, in particular, FIG. 19 is a plan view of the ink jet recording apparatus, and FIG. 20 is an elevational sectional view of the ink jet recording apparatus on which the ASF was mounted. In the ink jet recording apparatus according to this embodiment, a single sheet such as a normal recording sheet, a post card and the like (referred to as "cut sheet" hereinafter) and a continuous sheet such as a fanfold sheet can be used at a recording station.

That is to say, when the cut sheet is used, the cut sheet is supplied from the ASF or supplied manually. As shown in FIG. 20, the ASF comprises two trays 1030*a*, 1030*b*. With this arrangement, the cut sheets having different sizes can be set in the trays, respectively so that the desired sheet can be selected by the operator. Sheet supply mechanisms for the trays are the same as each other. That is to say, a plurality of cut sheets (not shown in FIG. 20) stacked on pressure plates 1031*a*, 1031*b* are urged against pick-up rollers 1033*a*, 1033*b* by springs 1032*a*, 1032*b*, so that the sheet can be separated and supplied one by one by the pick-up roller 1033*a* or 1033*b* rotated in response to a sheet supply start signal.

When the cut sheet is used, a regist roller 1011 is urged against a convey roller 1010 by a release lever (not shown) so that the cut sheet supplied from the ASF is conveyed to a recording station through a convey path by the rotation of the convey roller 1010. Near the recording station, a sheet holder plane 1012 is urged against the convey roller by a leaf spring so that a further conveying force is applied to the cut sheet. As a result, the cut sheet is conveyed between an ink jet head 1020*j* and a platen 1024. The conveyance of the cut sheet is effected intermittently whenever the ink jet head 1020*j* is scanned (described later), and the conveying amount is determined in accordance with a length of an array of discharge openings formed in the ink jet head 1020*j* in a sheet conveying direction.

The cut sheet on which an image was formed by injecting ink from the discharge openings of the ink jet head 1020*j* is conveyed upwardly and discharged out of the apparatus by an assist roller 1013 and a discharge roller 1014 (and associated spurs 1013*a*, 1014*a*).

When the continuous sheet is used, the ASF is not used, and, the continuous sheet supplied from a sheet supply inlet 1035 is conveyed by a pin-tractor 1003. In this case, the regist roller 1011 is separated from the convey roller 1010 by the release lever. As is in the cut sheet, the continuous sheet conveyed to the recording station is intermittently conveyed upwardly whenever the ink jet recording head 1020*j* is scanned; meanwhile the recording is effected. The ink jet head 1020*j* has 128 ink discharge openings arranged in a line, and the arranging direction corresponds to a sheet conveying direction (referred to as "sub-scan direction" hereinafter) when the ink jet recording head is mounted on a carriage 1021.

In the illustrated embodiment, the full-color recording can be effected by using yellow (Y) ink, magenta (M) ink, cyan (C) ink and black (Bk) ink and the mono-color recording can be effected by using only black (Bk) ink. When the full-color recording is effected, the ink jet heads 1020*j* and associated ink tanks 1020*t* containing Y, M, C, Bk inks, respectively are removably mounted on the carriage 1021 independently. With this arrangement, for example, if Y ink is consumed or if the Y tank is desired to be replaced, only such a tank can be changed to another ink tank, or if the ink jet head 1020*j* is desired to be replaced, only such an ink jet head can be changed to another one.

Incidentally, with the arrangement as mentioned above, the 128 ink discharge openings of each ink jet head 1020*j* are divided into four groups each corresponding to the specific color, and, in accordance with this situation, liquid chambers and liquid passages are formed. On the other hand, when the mono-color recording is effected, the ink jet head 1020*j* is integrally formed with the Bk ink tank 1020*t* as a unit which is removably mounted on the carriage 1021.

As mentioned above, the carriage 1021 on which the ink jet head(s) 1020*j* and the ink tank(s) 1020*t* were mounted can be shifted by a driving force of a carriage motor 1022 drivingly connected to the carriage via a belt 1023, as shown in FIG. 19. The carriage 1021 is slidably engaged with a guide shaft 1021*a* and a guide piece 1021*b* which extend in a left-and-right direction in FIG. 19 so that the carriage can be shifted along these elements, thereby permitting the recording scanning. In the non-recording condition, the carriage 1021 is shifted to a home position (left side in FIG. 19), and, as shown in FIG. 19, the discharge opening surface of the ink jet head 1020*j* is capped by a capping unit 1025.

Shift information of the carriage is detected by an encoder film 1024 provided in parallel with the guide shaft 1021*a* and optical or magnetic encoder elements 1051*a*, 1051*b* (FIG. 20) mounted on the carriage 1021 with the interposition of the film 1024 therebetween. Further, the communication of signals between the recording apparatus and the ink jet head 1020*j* is effected through a flexible substrate 1044.

As shown in FIG. 20, a sensor 1052 of reflection type is provided on the recording apparatus and is used to read code bar information provided on the ink jet head 1020*j* or the ink tank 1020*t*. With this arrangement, the ink jet head 1020*j* or the ink tank 1020*t* can be identified.

An ASF motor 1026 (FIG. 19) disposed near the home position of the recording apparatus is used to drive the pick-up roller of the ASF and a suction pump of the capping unit 1025. Further, a driving force required for driving the convey roller 1010 and conveying the recording sheet is obtained from a line feed motor (referred to as "LF motor" hereinafter) (not shown) disposed at a position remote from the home position through a gear train 1041 (FIG. 19). A control panel 1100, an inner interface substrate 1110 and a connector 1120 interconnecting these substrates are arranged on a chassis 1001 forming a bottom plate of the recording apparatus.

Figure 21:
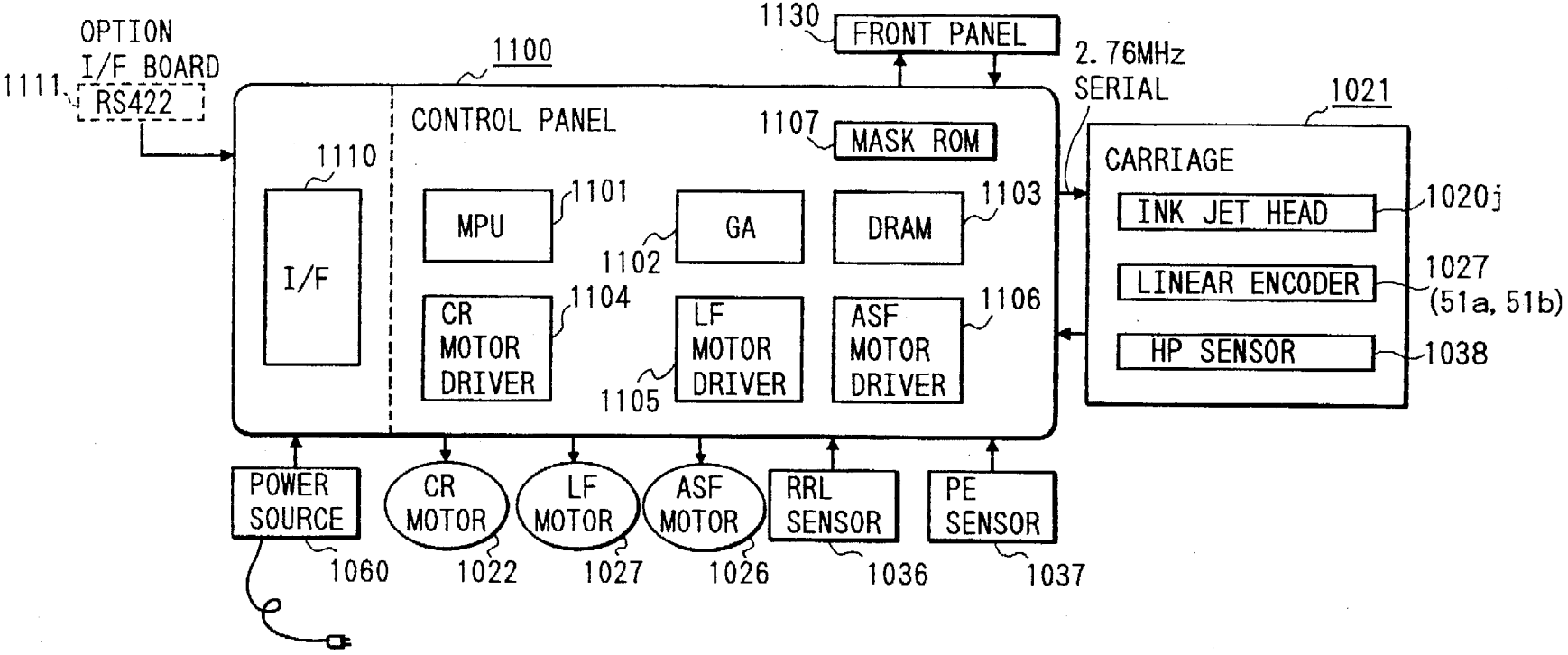
FIG. 21 is a block diagram showing a control portion of the ink jet recording apparatus shown in FIGS. 19 and 20.

FIG. 21 is a block diagram showing a control mechanism for the ink jet recording apparatus. The control panel 1100 is in the form of a printed circuit substrate and, as shown in FIG. 20, is arranged on the bottom of the apparatus. An MPU 1101, a gate array (GA) 1102, a dynamic RAM (DRAM) 1103 and a mask ROM (MASK ROM) 1107 are included in the control panel 1100. Further, the control panel also includes drive circuits for motors, i.e., a carriage (CR) motor driver 1104, a line feed (LF) motor driver 1105 and an ASF motor driver 1106.

The centronics interface (I/F) substrate 1110 in the form of a printed circuit substrate is connected to the control panel 1100 so that the control panel can receive recording data and the like from a host device. Incidentally, in the illustrated embodiment, an I/F substrate 1111 having different specification can be connected to the control panel so that the panel can cope with various host devices and treat other data.

In the control panel 1100, the MPU 1101 serves to perform the treatment of the data regarding the entire apparatus, the MASKROM 1107 serves to store the treating procedure program, and the DRAM 1103 is used as a work area regarding the data treatment. Various circuits relating to the data treatment effected by the MPU 1101 are formed in the gate array 1102. The MPU 1101 converts the image data sent from the host device through the I/F 1110 into discharge data used by the ink jet head **1020*j*, and sends the discharge data to a driver of the ink jet head 1020*j* in response to the discharge timing of the ink jet head 1020*j*. Further, the MPU 1101 drives the motors 1022, 1027, 1026 via the corresponding drivers 1104, 1105, 1106. Particularly, the drive control for the CR motor 1022 is effected together with the discharge control on the basis of linear encoder information obtained through the carriage 1021**.

Further, the MPU 1101 performs the treatment regarding key input and/or information display on a front panel 1130, and the treatments regarding the detection information from a home position (HP) sensor 1038, an RRL sensor 1036 and a paper end (PE) sensor 1037.

Incidentally, when the present invention is particularly applied to a recording head and a recording apparatus of the type wherein there is provided means (for example, electrothermal converter, laser light) for generating thermal energy as energy utilized to discharge the ink and the ink condition is changed by the thermal energy, the excellent advantage can be obtained. With this arrangement, high density recording and highly fine recording can be achieved.

Preferably, the typical construction and principle of the recording head can be realized by using the fundamental principles, for example, disclosed in U.S. Pat Nos. 4,723,129 and 5,740,796. Although this system can be applied to both a so-called "on-demand type" and "continuous type", it is more effective when the present invention is particularly applied to the on-demand type, because, by applying at least one drive signal corresponding the record information and capable of providing the abrupt temperature increase exceeding the nucleate boiling to the electrothermal converters arranged in correspondence to the sheet or liquid passages including the liquid (ink) therein, it is possible to form a bubble in the liquid in correspondence to the drive signal by generating the film boiling on the heat acting surface of the recording head due to the generation of the thermal energy in the electrothermal converters. Due to the growth and contraction of the bubble, the liquid is discharged from the discharge opening to form at least one liquid droplet. When the drive signal has a pulse shape, since the growth and contraction of the bubble can be quickly effected, more excellent liquid charge can be achieved. Such a pulse-shaped drive signal may be ones disclosed in U.S. Pat. Nos. 4,463,359 and 4,345,262. Incidentally, by adopting the condition disclosed in U.S. Pat. No. 4,313,124 providing the invention regarding the temperature increasing rate on the heat acting surface, a further excellent recording can be performed.

As the construction of the recording head, the present invention includes the construction wherein the heat acting portion is disposed in an arcuate area as disclosed in U.S. Pat. Nos. 4,558,333 and 4,459,600, as well as the constructions wherein the discharge openings, liquid passages and electrothermal converters are combined (straight liquid passages or orthogonal liquid passages), as disclosed in the above U.S. Patents. In addition, the present invention is applicable to the construction wherein each discharge opening is constituted by a slit with which a plurality of electrothermal converters are associated in common as disclosed in the Japanese Patent Laid-open No. 59-123670 and the construction wherein openings for absorbing the pressure wave of the thermal energy are arranged in correspondence to the discharge openings as disclosed in the Japanese Patent Laid-open No. 59-138461, because the recording can be correctly and efficiently performed regardless of the configuration of the recording head.

Further, the present invention can be applied to a recording head of full-line type having a length corresponding to a maximum width of a recording medium to be recorded. As such a recording head, the construction wherein such a length is attained by combining a plurality of recording heads or a single recording head integrally formed may be adopted.

In addition, among the above-mentioned serial types, the present invention is effectively applicable to a recording head secured to a carriage, or a removable recording head of chip type wherein, when mounted on a carriage, electrical connection between it and the recording system and the supply of ink from the recording system can be permitted, or to a recording head of cartridge type wherein a cartridge is integrally formed with the recording head itself.

Further, it is preferable that a head recovery means and an auxiliary aiding means are added to the recording head according to the present invention, since the effect of the present invention is further improved. More particularly, these means include a capping means for capping the recording head, a cleaning means, a pressurizing or suction means, and an auxiliary heating means comprising electrothermal converters or other heating elements or combination thereof. Further, it is effective for the stable recording to perform an auxiliary discharge mode wherein the ink discharge not relating to the recording ink discharge is effected.

Further, as to the kind and number of the recording heads to be mounted, each recording head may correspond to each different color ink, or a plurality of recording heads can be used for a plurality of inks having different colors and/or different densities. That is to say, for example, the present invention can effectively be applied not only to a recording mode with a single main color such as black, but also to a system providing a plurality of different colors and/or a full-color by mixing colors by using an integrated recording head or combination of plural recording heads.

Furthermore, in the illustrated embodiments, while the ink was liquid, the ink may be solid in a room temperature or less and softened or liquidized at the room temperature. In the ink jet recording systems, since the temperature control is generally effected in a temperature range from 30° C. to 70° C. so that the viscosity of the ink is maintained within a stable discharging range, the ink may be liquidized when the record signal is emitted. In addition, ink having a feature that is firstly liquidized by the thermal energy, such as solid ink which serves to prevent the increase in temperature by absorbing energy in changing the ink from the solid state to the liquid state or which is in the solid state in the reserved condition to prevent the vaporization of the ink and which is liquidized by application of the thermal energy into liquid ink to be discharged in response to the record signal, or ink which has already been solidified upon reaching the recording medium, can also be applied to the present invention. In such a case, the ink can be held in the liquid state or solid state in recesses or holes in a porous sheet as disclosed in the Japanese Patent Laid-open Nos. 54-56847 and 60-71260, in a confronting relation to the electrothermal converters. Incidentally, in the present invention, the above-mentioned film boiling principle is most effective for each ink.

Further, the aforementioned ink jet recording apparatus may be used as image output terminals of information processing systems such as computers or may be used with a copying machine incorporating a reader therein or a facsimile system having transmission/ receiver function.

What is claimed is:

1. A recording apparatus for recording an image on a sheet supplied from a plurality of sheet supply portions by a recording means and having a common drive source for driving the sheet supply portions, each of said sheet supplying portions comprising:

sheet supporting means for supporting sheets;

rotatable sheet supply means for supplying the sheets supported on said sheet supporting means;

drive transmitting means for transmitting a driving force of said common drive source to said sheet supply means;

a spring clutch disposed in said drive transmitting means for transmitting or interrupting the driving force, wherein said spring clutch has a spring which is tightened or loosened, a control ring engaged by said spring and a control pawl which regulates said control ring to loosen said spring, wherein the drive force is transmitted from said common drive source to said sheet supply means when said spring is tightened and the drive force is interrupted when said spring is loosened; and control means having a rotatable cam and cam follower slidingly contacting a cam surface of said cam, said cam follower shifts said control pawl between a regulating position on which regulates said control ring and a not-regulating position when the cam is rotated, wherein the cams of the plurality of sheet supplying portions having different cam surfaces so that one of said spring is loosened while the other spring is tightened when the cams are rotated in predetermined rotational amount.

2. A sheet supply apparats for selecting and supplying a sheet from a plurality of sheet supply portions and having a common drive source for driving the sheet supply portions, each of said sheet supply portions comprising:

sheet supporting means for supporting sheets;

rotatable sheet supply means for supplying the sheets supported on said sheet supporting means;

drive transmitting means for transmitting a driving force of said common drive source to said sheet supply means;

a spring clutch disposed in said drive transmitting means for transmitting or interrupting the driving force, wherein said spring clutch has a spring which is tightened or loosened, a control ring engaged by said spring and a control pawl which regulates said control ring to loosen said spring, wherein the drive force is transmitted from said common drive source to said sheet supply means when said spring is tightened and the drive force is interrupted when said spring is loosened; and control means having a rotatable cam and cam follower slidingly contacting a cam surface of said cam, wherein said cam follower shifts said control pawl between a regulating position on which regulates said control ring and a not-regulating position when the cam is rotated, wherein the cams of the plurality of sheet supplying portions have different cam surfaces so that one of said spring is loosened while the other spring is tightened when the cams are rotated in predetermined rotational amount.

3. A sheet supplying apparatus according to claim 2, wherein said cam is rotated by said common drive source.

4. A sheet supplying apparatus according to claim 2, wherein said spring clutch and said cam are provided coaxially on a same axis.

5. A recording apparatus for recording an image on a sheet supplied from a plurality of sheet supply portions and having a common drive source for driving the sheet supply portions by a recording means, each of said sheet supply portions comprising:

sheet supporting means for supporting sheets;

rotatable sheet supply means for supplying the sheets supported on said sheet supporting means;

drive transmitting means for transmitting a driving force of said common drive source to said sheet supply means;

a spring clutch disposed in said drive transmitting means for transmitting or interrupting the drive force, wherein said spring clutch has a spring which is wound around an input member and an output member to connect said input member and said output member when it is tightened, and the drive force is transmitted from said drive source to said sheet supply means when said input member and output member are connected; and control means having a cam rotated by the drive force of said common drive source for tightening and loosening said spring of said spring clutch in accordance with a rotational amount of said cam;

wherein the cams of the plurality of sheet supply portions are configured so that one of said spring clutches transmits the drive force while the other of said spring clutches interrupt the drive force when the cams are rotated by said common drive source.

6. A recording apparatus according to claim 5, wherein each of said sheet supply portions is removably mounted onto a main body of said apparatus.

7. A recording apparatus according to claim 5, wherein said recording means is of ink jet type.

8. A sheet supplying apparatus for selecting and supplying a sheet from a plurality of sheet supply portion and having a common drive source for driving the sheet supply portion, each of said sheet supply portion comprising:

a sheet supporting means for supporting sheets;

rotatable sheet supply means for supplying the sheets supported on said sheet supporting means;

drive transmitting for means for transmitting a drive force of said common drive source to said sheet means;

a spring clutch disposed in said drive transmitting means for transmitting or interrupting the drive force, wherein said spring clutch has a spring which is wound around an input member and an output member to connect said input member and said output member when it is tightened, and the drive force is transmitted from said drive source to said sheet supply means when said input member and output member are connected; and control means having a cam rotated by the drive force of said common drive source for tightening and lossening the spring of said spring clutch in accordance with a rotational amount of said cam;

wherein the cam of plurality of sheet supplying portion are configured so that one of said spring clutches transmits the drive force while the other of said spring clutches interrupt the drive force when the cams are rotated by said common drive source.

9. A sheet supplying apparatus according to claim 8, wherein each of said output member is rotary shaft connected with sheet supply means, and each of said input member is transmission gear rotatably mounted on said rotary shaft and to which the drive force of said source is transmitted, and each of said spring clutch connects or interrupts the transmission gear and the rotary shaft wherein each of said control means controls said spring clutch to change it from a connecting condition to an interrupting condition by a predetermined rotation amount of said cam.

10. A sheet supply apparatus according to claim 2, wherein each of said springs is wound around said rotary shaft and said transmission gear to connect said transmission gear and said rotary shaft when it is tightened, and each of said spring clutches has a control ring engaged by said spring to tighten said spring when rotated together with said transmission gear, and each of said control means has a control pawl for stopping rotation of said control ring to loosen said spring clutch.

11. A sheet supplying apparatus according to claim 10, wherein a ratch portion is formed on an outer periphery of said control ring a rotation of which stops by engaging said control pawl by said ratch portion.

12. A sheet supplying apparatus according to claim 10, wherein said control pawl is rockable to engaged with or disengaged from said control ring, and wherein said cam rocks said control pawl by sliding contacting with a cam follower provided on said control pawl.

13. A sheet supplying apparatus according to claim 9, wherein each of cams is mounted on said rotary shaft for rotational movement is response to rotation of said transmission gear and has a cam surface for separating said control pawl from said control ring by rotation of said drive source, and wherein said cam surface are disposed at different positions in accordance with the respective sheet supply portion, and said cam follower selected in accordance with the rotation amount of said drive source reaches the corresponding cam surface.

14. A sheet supplying apparatus according to claim 13, wherein said cam follower is shifted toward the corresponding cam surface by repeating normal and reverse rotation by said drive source.

15. A sheet supply apparatus according to claim 12 wherein each of said cams is connected to said drive source via a one-way clutch to be rotated only reversely by said drive source, and each of said cams has a projection with which said cam follower is slidingly contacted to separate said control pawl from said control ring, and wherein said cam followers are disposed to abut against said cams at different positions along a circumferential direction thereof in accordance with the respective sheet supply portions, and one of said projections selected in accordance with the reverse rotations amount of said drive source slidingly contacts with said cam follower.

16. A sheet supplying apparatus according to claim 9, wherein each of said cams and each of said spring clutches are disposed coaxially on a rotation shaft of said sheet supply means.

17. A sheet supplying apparatus according to claim 9, further comprising a slide member is disposed between each of said transmission gear and each of said cam to generate sliding movement therebetween to regulate the rotation of said cam over the predetermined amount.

* * * * *

UNITED STATES PATENT AND TRADEMARK OFFICE

CERTIFICATE OF CORRECTION

PATENT NO. : 5,738,453
DATED : April 14, 1998
INVENTOR(S) : Kenichi TSUBURAYA, et al.

It is certified that error appears in the above-identified patent and that said Letters Patent is hereby corrected as shown below:

Column 11, line 36, after "and", insert --an--.

Column 13, line 34, after "serves", insert --to--;
Line 49, after "Δ", insert --is--;
Lines 64 and 65, delete "in synchronous" and insert therefor --synchronously--.

Column 15, line 18, delete "of" and insert therefor --or--.
Line 24, delete "to".

Column 17, line 64, after "corresponding", insert --to--.

Column 19, line 56, after "which", insert --said cam--;
Line 64, delete "apparats" and insert therefor --apparatus--.

Column 20, line 19, after "which", insert --said cam--;
Line 67, delete "portion" and insert therefor --portions--.

Column 21, lines 1 and 2, delete "portion", both occurrences, and insert therefor --portions--;
Line 3, delete "a";
Line 6, delete "for", first occurrence;
Line 7, after "sheet", insert --supply--;
Line 18, delete "lossening" and insert therefor --loosening--;
Line 21, delete "cam" and insert therefor --cams--; and after "of", first occurrence, insert --said--; and delete "portion" and insert therefor --portions--;

UNITED STATES PATENT AND TRADEMARK OFFICE

CERTIFICATE OF CORRECTION

PATENT NO. : 5,738,453
DATED : April 14, 1998
INVENTOR(S) : Kenichi TSUBURAYA, et al.

It is certified that error appears in the above-identified patent and that said Letters Patent is hereby corrected as shown below:

Column 21 (continued):

Line 27, delete "member" and insert therefor --members--; and after "is", insert --a--;
Line 29, after "is", insert --a--;
Line 30, after "said", insert --drive--;
Line 35, delete "rotation" and insert therefor --rotational--;
Line 36, delete "2" and insert therefor --9--.

Column 22, line 4, after "to", insert --be--;

Line 5, delete "wherein";
Line 6, delete "sliding" and insert therefor --slidingly--;
Line 9, after "of", insert --said--;
Line 10, delete "is" and insert therefor --in--;
Line 13, delete "surface" and insert therefor --surfaces--;
Line 15, delete "portion" and insert therefor --portions--;
Line 16, delete "rotation" and insert therefor --rotational--;
Line 21, delete "rotation" and insert therefor --rotations--;
Line 33, delete "rotations" and insert therefor --rotation--.

Signed and Sealed this

Twenty-fourth Day of November, 1998

*Attest:*

*Attesting Officer*

Bruce Lehman

BRUCE LEHMAN

*Commissioner of Patents and Trademarks*